US005940662A

United States Patent [19]

Hano et al.

[11] Patent Number: 5,940,662

[45] Date of Patent: Aug. 17, 1999

[54] CHARGING APPARATUS AND ELECTROPHOTOGRAPHIC APPARATUS

[75] Inventors: Yoshifumi Hano, Susono; Shuichi Aita, Mishima; Tsutomu Kukimoto, Yokohama; Tsuyoshi Takiguchi; Fumihiro Arahira, both of Shizuoka-ken; Yuji Ishihara, Kawasaki; Kiyoshi Mizoe, Numazu, all of Japan

[73] Assignee: Canon Kabushiki Kaisha, Tokyo, Japan

[21] Appl. No.: 08/801,921

[22] Filed: Feb. 14, 1997

[30] Foreign Application Priority Data

| | | | |
|---|---|---|---|
| Feb. 14, 1996 | [JP] | Japan | 8-026681 |
| Apr. 23, 1996 | [JP] | Japan | 8-100956 |
| Apr. 23, 1996 | [JP] | Japan | 8-100965 |
| Apr. 23, 1996 | [JP] | Japan | 8-100966 |

[51] Int. Cl.[6] ..... G03G 15/02

[52] U.S. Cl. ..... 399/175

[58] Field of Search ..... 399/50, 168, 174, 399/175, 176; 430/108

[56] References Cited

U.S. PATENT DOCUMENTS

| | | | |
|---|---|---|---|
| 5,252,398 | 10/1993 | Ohtani et al. | 430/108 X |
| 5,351,109 | 9/1994 | Haneda | 399/175 |
| 5,367,365 | 11/1994 | Haneda et al. | 399/174 |
| 5,406,353 | 4/1995 | Asanae | 399/174 |
| 5,592,264 | 1/1997 | Shigeta et al. | 399/175 |
| 5,606,401 | 2/1997 | Yano . | |
| 5,659,852 | 8/1997 | Chigono et al. | 399/175 |

*Primary Examiner*—Sandra Brase

*Attorney, Agent, or Firm*—Fitzpatrick, Cella, Harper & Scinto

[57] ABSTRACT

A charging apparatus which comprises an electrophotographic photosensitive member and a charging member which comprises magnetic particles and placed in contact with the electrophotographic photosensitive member to charge the electrophotographic photosensitive member upon application of a voltage, wherein each magnetic particle has a surface layer containing a polyolefin resin of which weight average molecular weight is 10,000 or more, and has a volume resistivity of $1\times10^4$ to $1\times10^{11}$ Ωcm.

12 Claims, 6 Drawing Sheets

CHARGING APPARATUS AND ELECTROPHOTOGRAPHIC APPARATUS

BACKGROUND OF THE INVENTION

1. Field of the Invention

The present invention relates to a charging apparatus, which comprises an electrophotographic photosensitive member and a charging member which is placed in contact with the photosensitive member and electrifies the photosensitive member upon the application of a voltage, and an electrophotographic apparatus having such a charging apparatus.

2. Related Background Art

Among a number of known methods in electrophotography, the following method is generally employed; an electrostatic latent image is formed on a photosensitive member by the means of a charging means and an image-exposure means, and the latent image is developed with a toner to make a visible image (a toner image) which is then transferred to a transfer material such as paper and fixed by heat, pressure etc. Finally, the toner particles not transferred and which remain on the photosensitive member are removed from the photosensitive member in a cleaning step.

Recently, various organic photoconductive compounds have been developed as the photoconductive material to be used in the electrophotographic photosensitive member. The photosensitive member utilizing such a compound, especially of a functionally-separated type where the charge-generating layer and the charge-transporting layer are laminated, has been mounted on copying machines, printers and facsimiles. In such apparatuses, the corona charger has been used as a charging means. Corona charging, however, generates a large amount of ozone, necessitating filter equipment, thus increasing the apparatus size as well as the operation cost.

As a technique to solve such a problem, there has been developed a charging method with as little ozone generation as possible, wherein a charging member such as a roller or a blade electric is contacted with the surface of the photosensitive member to achieve the electric discharge interpretable by Paschen's law, utilizing the narrow space near the contact portion.

In particular, roller charging using a conductive roller as a charging member, is preferably used because it provides stable charging.

In the roller charging system, charging is mainly carried out by the discharge from the charging member to the member to be charged. Charging takes place when a voltage above a certain threshold value is applied. For example, when a charging roller is brought into contact with a photosensitive member having a photosensitive layer of 25 $\mu$m thick containing an organic photoconductor, the surface potential of the photosensitive member starts to rise at a voltage of about 640 kV, and beyond the threshold voltage the photosensitive member surface potential linearly increases at a slope of 1 to the applied voltage. This threshold value voltage is hereinafter defined as charging starting voltage $V_{th}$. Namely, in order to obtain a necessary surface potential $V_d$ of the photosensitive member for electrophotography, a high DC voltage of $V_d+V_{th}$ must be applied to the charging roller, and it is difficult to control the potential of the photosensitive member at the desired value since the resistance value of the contact charging member varies depending on the environmental changes.

Thus, in order to achieve more uniform charging, as disclosed in Japanese Patent Application Laid-Open No. 63-149669, AC charging is applied to the contact charging member, which is a voltage produced by superimposing an AC component having a peak-to-peak voltage of $2\times V_{th}$ or above, on a DC voltage corresponding to the desired $V_d$. This method aims at a potential-leveling effect due to AC, where the potential of the charged member converges to $V_d$, the middle point of the AC peak potentials, and is by no means affected by an external disturbance such as environmental changes.

However, even by such a charging method, the fundamental charging mechanism utilizes the discharge phenomenon from the charging member to the photosensitive member. Hence, as previously stated, the voltage necessary for charging must be higher than the photosensitive member surface potential. Also, some new problems such as vibration of the photosensitive member and the charging means or noise (AC charging noise) due to the electric field of AC voltage, as well as the deterioration of the surface of the photosensitive member due to the electric discharge, have emerged.

On the other hand, so-called injection charging has been known as a charging method of better charging efficiency, where electric charge is directly injected into the photosensitive member.

This is a method to inject electric charge into the trap level on the photosensitive member by applying a voltage to a charging means such as a charging roller, charging fiber brush, and charging magnetic brush (see Japan Hardcopy articles 1992, p.287 "Contact charging properties using an electroconductive roller", etc.). In these methods, however, charge injection is carried out using a charging member of low resistance to which a voltage is applied, and it is essential that the resistance of the charging member is sufficiently low and that a sufficient amount of the material providing the electroconductivity to the member, such as an electroconductive filler, is exposed on the surface. Thus, in the above mentioned article, it is said that the preferred charging member is aluminum foil, or an ion-conductive charging member which has a sufficiently low resistance value under humid conditions. According to the study of the inventors, the maximum resistance value enabling sufficient charge injection is $1\times10^3$ Ω, and if higher, problems will occur in the convergence of charge potential due to the difference between the applied voltage and charge potential.

However, when a charging member having a low resistance value is actually used, an excess leak current flows from the charging member to a drum having scratches or pinholes on the drum surface, which causes faulty charging around the fault, expansion of pinholes and electrical breakdown of the charging member.

To prevent these problems, the charging member must have a resistance value of about $1\times10^4$ Ω or above, but there arises a contradiction that such a charging member has above-mentioned problems and the charge injection to the photosensitive member is decreased resulting in no charging.

Therefore, it has been desired to solve the above problems in the contact charging apparatus or the electrophotographic apparatus using a contact charging apparatus.

In addition, in the charging apparatus where a charging means comes in contact with the photosensitive member, the charging properties will vary due to the soil (contamination) of the charging member, which tends to cause image defects and reduced durability.

It is considered that the contamination of the charging member is caused by the toner attached to the surface of the charging member due to the friction between the toner and the charging member. The toner is the residual toner not cleaned at the cleaning portion which remains on the photosensitive member, and is then taken into the charging member.

In order to provide resistance to contamination to the charging member, a surface layer is formed on the charging member by coating with a contamination-resistant resin.

Generally speaking, however, resins excellent in providing contamination-resistance are not good in adhesiveness with the core material, and the surface layer made of such a resin often peels off with use due to the poor adhesiveness or hardness of the surface layer.

Further, when the core is a magnetic particle, these particles easily aggregate together with long use (so-called blocking), resulting in uneven charging. This is a technical problem specific in the charging step, since such a phenomenon hardly occurs in the developing step where the ratio of toner particles to the magnetic particles is large.

Thus, it is urgently required to design the most appropriate surface layer and to prevent charging defects from occurring for a long time to enable the user to make a large number of copies. This is also the case with injection charging of the photosensitive member.

SUMMARY OF THE INVENTION

The object of the present invention is to provide a charging apparatus which is resistant to contamination and blocking, maintains good charging properties for a long time, as well as an electrophotographic apparatus employing such charging apparatus. The object of the present invention is also to provide a charging apparatus which can achieve good injection charging for a long period of time, as well as an electrophotographic apparatus employing it.

One embodiment of the present invention is a charging apparatus comprising an electrophotographic photosensitive member and a charging member which comprises magnetic particles and placed in contact with the electrophotographic photosensitive member to charge the electrophotographic photosensitive member when applied with a voltage, wherein each magnetic particle has a surface layer containing a polyolefin resin of which weight average molecular weight is 10,000 or more, and has a volume resistivity of $1\times10^4$ to $1\times10^{11}$ Ω cm.

Another embodiment of the present invention is an electrophotographic apparatus comprising an electrophotographic photosensitive member, an exposure means, a developing means, a transfer means, and a charging means which comprises magnetic particles and is placed in contact with the electrophotographic photosensitive member to charge the electrophotographic photosensitive member upon when applied with a voltage, wherein each magnetic particle has a surface layer containing a polyolefin resin of which weight average molecular weight is 10,000 or more, and has a volume resistivity of $1\times10^4$ to $1\times10^{11}$ Ω cm.

DETAILED DESCRIPTION OF THE PREFERRED EMBODIMENT

Figure 1:
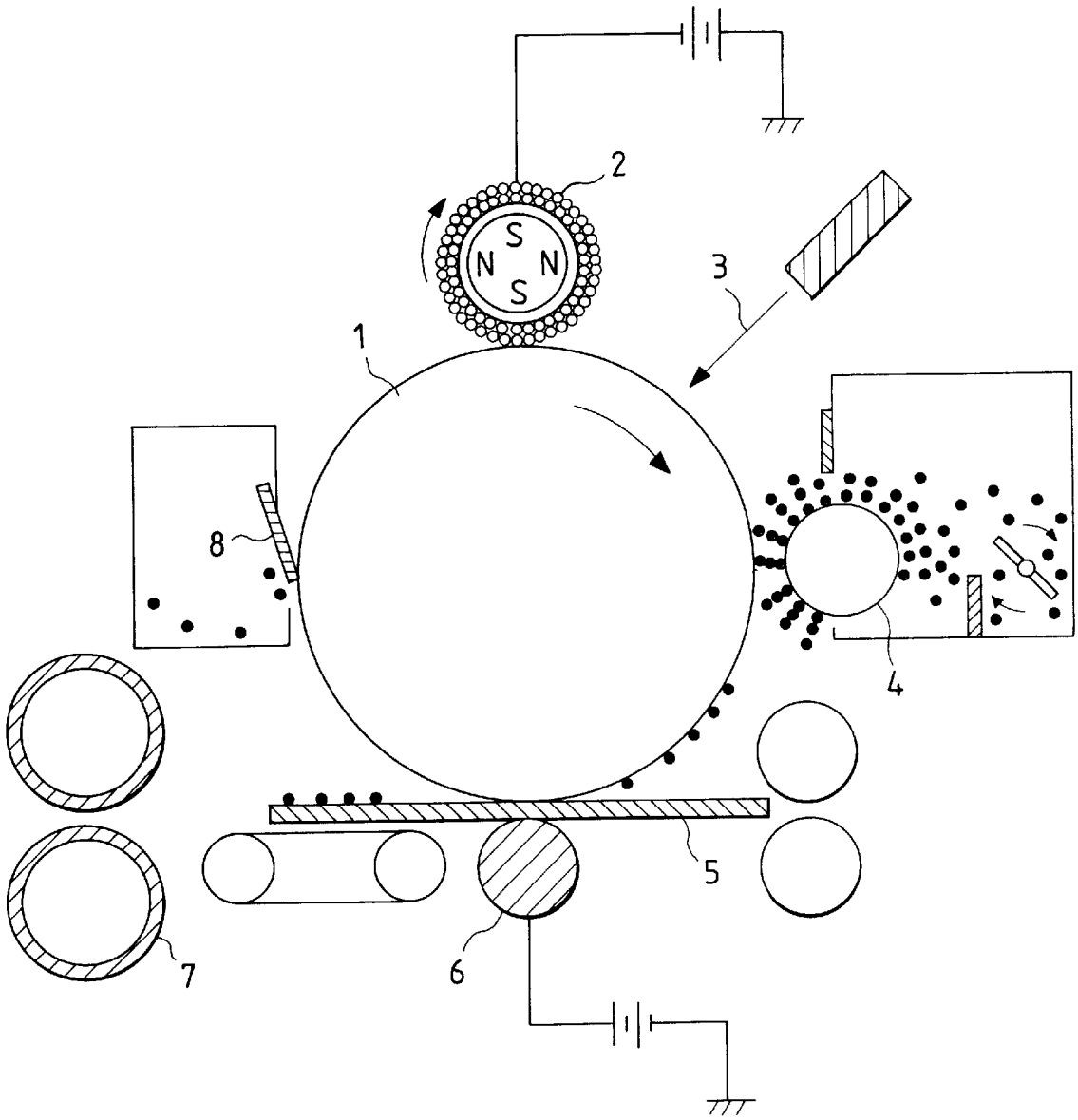
FIG. 1 shows a schematic constitution of an electrophotographic apparatus employing the charging apparatus of the invention.

The charging apparatus or the electrophotographic apparatus of the present invention comprises an electrophotographic photosensitive member and a charging member which comprises magnetic particles and placed in contact with the electrophotographic photosensitive member to charge the electrophotographic photosensitive member when applied with a voltage, wherein each magnetic particle has a surface layer containing a polyolefin resin of which weight average molecular weight is 10,000 or more, and has a volume resistivity of $1\times10^4$ to $1\times10^{11}$ Ω cm.

The polyolefin resins usable in the present invention include those obtained by polymerizing or copolymerizing ethylene, propylene, butylene etc.

The weight average molecular weight Mw of the polyolefin resin is preferably 30,000 or more, more preferably from 50,000 to 500,000, since if Mw is less than 10,000, the blocking resistance and the wear resistance are not sufficient.

The polyolefin resin used in the present invention has a main peak at a molecular weight of 10,000 or more (P1) in GPC chromatography, and preferably has at least another peak or a shoulder at a molecular weight (P2) lower than the main peak. The presence of the main peak at a high molecular weight contributes to the prevention of the surface contamination due to the toner, as well as the improvement of the wear resistance of the resin.

The presence of a subpeak or a shoulder at a lower molecular weight contributes to the improvement of the adhesiveness between the core magnetic particles and the resin to prevent the peeling off of the covering resin from the magnetic particles. By the synergistic effect of these, the magnetic particles of the charging member exposed to strong shear hardly deteriorate, and it is possible to obtain uniform charging even after long use, thus maintaining good images.

Specifically, the molecular weight of the main a peak (P1) of the polyolefin resin used in the invention is preferably 30,000 to 400,000, and at the same time the molecular weight of at least one of the subpeaks or shoulders present at the lower molecular weight region is preferably 3,000 to 30,000 when the wear resistance and adhesiveness of the surface layer and the core material under long-term shear conditions are considered. In the present invention, the position of the peak/shoulder is designated by the inflection point of the differential curve of the chromatogram.

Also, the resin preferably has a weight average molecular weight (Mw) in a range of 50,000 to 500,000, a number average molecular weight (Mn) in a range of 5,000 to 50,000, Mw/Mn of 10 or more, a Z average molecular weight (Mz) in a range of 1,000,000 to 5,000,000, which enhances the effect of the invention. More preferably, the resin has a main peak at the molecular weight of 50,000 to 300,000, the peak or shoulder at the lower molecular weight of 3,000 to 15,000, Mw of 100,000 to 500,000, Mn of 7,000 to 40,000, Mw/Mn of 20 or more, and Mz of 1,500,000 to 4,500,000.

It is also preferable that the molecular weight ratio (P1:P2) of the main peak and the peak or shoulder of lower molecular weight is 3:1 to 100:1, in view of the compatibility of the adhesiveness to the magnetic particles and the wear resistance. More preferably, P1:P2 is 5:1 to 50:1 for the lasting effect.

Molecular weight determination of the polyolefin resins in the present invention is carried out using a gel permeation chromatography apparatus GPC-150C (Waters Inc.) under following conditions.

| | |
|---|---|
| Column: | Two Shodex HT-806M columns with a precolumn of Shodex HT-800P |
| Temperature: | 145° C. for polyethylene resins<br>40° C. for other resins |
| Solvent: | o-Dichlorobenzene (0.1% ionol added) for polyethylene resins<br>Tetrahydrofuran for other resins |
| Flow rate: | 1.0 ml/min |
| Sample: | 0.4 ml of 0.15% sample solution is injected. |

When the molecular weight of the coating resin of the magnetic particles is measured, the coated magnetic particles are extracted using a Soxhlet extractor with xylene for 20 hr, and after xylene was removed from the extract using an evaporator etc., the dried solid residue is used as a sample. In the calculation of the molecular weight of the sample, a calibration curve prepared using monodispersed polystyrene standards is used.

In the present invention, the polyolefin resin may be used in combination with any of following resins, so long as the effect of the present invention is obtained: polyamide resins such as nylon 6, and nylon 6,6, polyester resins such as polyethylene terephthalate, epoxy resin, silicone resins such as methylphenyl silicone and silicone acrylate, vinyl chloride resins, polyurethane resins, fluorine resins such as polytetrafluoroethylne perfluoroalkylvinylether copolymer and polyvinylidenefluoride, polycarbonate resins, melamine resins, styrol resins, acrylic resins such as polymethacrylate, polyacetal resins, vinylacetate resin and phenol resins.

In the present invention, the resistance of the charging member is preferably $1\times10^4$ Ω to $1\times10^{11}$ Ω. With a resistance value of less than $1\times10^4$ Ω, pin hole leak easily occurs, while with a resistance value of greater than $1\times10^{11}$ Ω, satisfactory charging becomes difficult. In order to maintain the resistance value of the charging member within the above range, the volume resistivity of the magnetic particles of the present invention is $1\times10^4$ Ω cm to $1\times10^{11}$ Ω cm.

When the charging apparatus of the present invention is used for injection charging, it must perform two functions; the satisfactory injection of electric charges into a charge injection layer of the photosensitive member, and prevention of the damage of both the charging member and the photosensitive member due to the concentration of the charging current at a defect such as a pin hole on the photosensitive member.

From this point of view, the desirable resistance of the charging member is $1\times10^4$ Ω to $1\times10^9$ Ω, preferably $1\times10^4$ Ω to $1\times10^7$ Ω. When the resistance value of the charging member is less than $1\times10^4$ Ω, pin hole leak will easily occur. When the resistance value is greater than $1\times10^9$ Ω, unsatisfactory charging tends to occur. In order to maintain the resistance value of the charging member within the above described range, the desirable volume resistivity of the magnetic particles of the present invention is preferably $1\times10^4$ Ω cm to $1\times10^9$ Ω cm, and more preferably $1\times10^4$ Ω cm to $1\times10^7$ Ω cm.

When the charging apparatus of the present invention is used for charging utilizing electric discharge, not for injection charging, the resistance value of the charging member is preferably $1\times10^5$ Ω to $1\times10^{11}$ Ω, and the desirable volume resistance of the magnetic particles is $1\times10^6$ Ω cm to $1\times10^{11}$ Ω cm.

Figure 2:
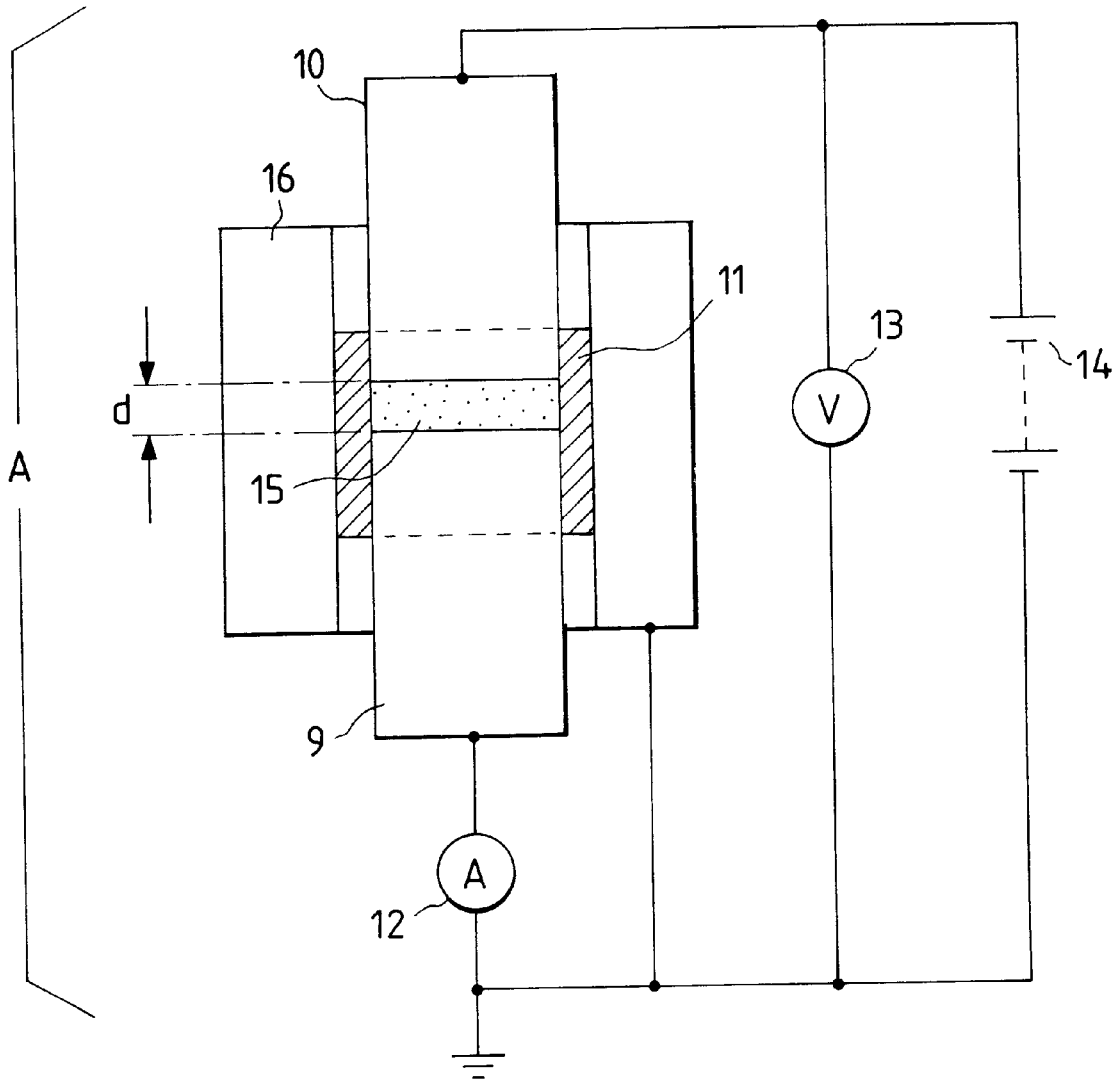
FIG. 2 shows a sectional view of the constitution of an apparatus to be used for measurement of the volume resistance of the magnetic particles of the invention.

The volume resistance of the magnetic particles used for the charging member is measured by an electric resistance measurement device shown in FIG. 2. More specifically, cell A is filled with the magnetic particles, and electrodes 9 and 10 are so positioned that they contact the magnetic particles. A voltage is applied between the electrodes 9 and 10, and the current flowing at the moment is measured to determine the volume resistance. The measurement conditions are: temperature 23° C. and humidity 65%; contact area S between the magnetic particles and the cell A 2 $cm^2$; thickness d 1 mm; load on the upper electrode 10 kg; applied voltage 100 V.

In FIG. 2, reference numeral 9 denotes a primary electrode; 10, an upper electrode; 11, an insulating material; 12, an ammeter; 13, a voltmeter; 14, a voltage stabilizer; 15, magnetic particles; and 16, a guide ring.

In the present invention, the magnetic particles form ears on a conductive member (sleeve) by magnetism to form a magnetic brush. The magnetic brush is brought into contact with the photosensitive member, as a charging member. Accordingly, an alloy or a compound that contains a ferromagnetic element such as cobalt or nickel is employed for the magnetic particles of the charging member.

Since the original volume resistance of such a material does not fall within a desired range, it is processed before use to have a volume resistance in a desired range by oxidization or reduction, for example, ferrite by composition adjustment, Zn—Cu ferrite by hydrogen reduction, or magnetite by oxidization.

It is desirable that the diameter of the magnetic particles of the present invention be 10 to 100 μm. If the diameter is smaller than 10 μm, the magnetic particles tend to adhere to the photosensitive member. If the diameter is greater than 100 μm, the magnetic brush formed on the sleeve cannot have a sufficient density, often resulting in uneven charging. The more preferable diameter of the magnetic particles is 15 to 50 μm. The diameter of the magnetic particles are determined using a laser diffraction particle distribution measurement device HEROS (manufactured by JEOL Ltd.), dividing the range of 0.05 to 200 μm into 32 in logarithmic scale, and the length of 50% volume distribution was taken as the mean diameter of the magnetic particles.

It is preferable that the amount of the surface layer in relation to the core material (magnetic particles) is 0.1 to 2.0 weight % in solid. If it is less than 0.1 weight %, the coating effect is not adequate. With 20 weight % or higher, charging is not improved even when the conductive particles are dispersed in the layer, and adhesiveness to the core material deteriorates, often resulting in peeling off of the film and falling off of the conductive particles, and also the increase of the manufacturing cost is not desirable.

In the present invention, the surface layer does not necessary cover the core member completely, and the core material may be exposed to a certain degree so long as the effects of this invention are obtained. In other words, the surface layer may be formed discontinuously.

The manufacturing method for the magnetic particles in the present invention is not particularly limited, and a conventional method such as spray-drying, or dry-coating can be employed. Particularly, for the present invention, it is preferable to use a method disclosed in, for example, Japanese Patent Application Laid-Open No. 60-106808 or 60-06809. According to this method, a polyolefin resin layer is formed directly on the surface of the magnetic particles (direct polymerization), so that the resin coated magnetic particles are superior in strength and durability when the resin of the present invention is used. In addition, by controlling the molecular weight appropriately, the adhesiveness of the polyolefin resin and the core material can be improved further.

When a resin surface layer is provided on the surface of the magnetic particles, the resistance of the resultant magnetic particles is increased since usually the resistance of resin is high. Depending on the coating amount, the charging properties may be degraded compared with those having no surface layer. In this case, conductive particles are dispersed in the surface layer to make the resistance of the surface layer almost equal to that of the core material. However, the use of magnetic particles invites the reduction of adhesiveness to the core material, the reduction of film strength, as well as the release of conductive particles, in spite of the improvement of charging properties. As a result, the charging characteristics tend to change, causing a problem in long term use.

In the present invention, since a polyolefin resin having a weight-average molecular weight of 10,000 or more is employed, an appropriate resistance value can be obtained for the charging member by making the layer into a thin film, or by dispersing conductive particles in the layer.

Generally, as the diameter of the magnetic particles becomes smaller, it becomes more difficult to coat them uniformly. In the present invention, however, the magnetic particles can be completely coated by using direct polymerization, thus enabling good charging properties for a long time.

Common conductive particles can be used for the present invention: metals, such as copper, nickel, iron, aluminum, gold or silver; metal oxides, such as iron oxide, zinc oxide, tin oxide, antimony oxide, or titanium oxide; or conductive powders, such as carbon black. A surface processing may be done on these particles as needed for hydrophobicity or resistance control. The conductive particles to use should be selected taking into consideration the dispersibility in the resin and the productivity.

The magnetic particles described above are generally used in a form where they are held on a conductive member (sleeve) such as a metal cylinder or metal foil which contains permanent magnets inside for attracting magnetic particles and has an arbitrary surface roughness.

The charging member thus formed is used in a condition of press-contact with the photosensitive member, where it is held by a suppression means such as a spring to form a charging nip with the photosensitive member.

In addition, from the viewpoint of high precision image formation, it is preferable that a voltage enough to raise the potential at the surface of the photosensitive member to 400 V or higher, more preferably higher than 500 V, is applied to the magnetic particles constituting the charging member. For injection charging, it is also preferable, from the view point of uniform charging, that an AC voltage component having a peak-to-peak voltage of $2\times V_{th}$ (V) or less is superposed to the DC voltage. For charging by electric discharge, it is preferable from the viewpoint of uniform charging that an AC voltage component having a peak-to-peak voltage of $2\times V_{th}$ or more is superposed to the DC voltage.

In general, in the charging method employing a charging member consisting of magnetic particles, magnetic particles tend to be pushed toward the end regions in the longitudinal direction (the direction of the generatrix of the photosensitive member) of the charging member with use, so that the charging member tends to make uneven contact with the photosensitive member at the areas near the end (end areas or end portions).

When the contact becomes non-uniform at the end areas, the potential of the photosensitive member corresponding to the end areas of the charging member becomes partly lower than at the center portion. Due to this potential reduction, the difference between the electrode sleeve potential and the photosensitive member surface potential becomes so large that the magnetic particles migrate from the charging member to the photosensitive member (attach to the photosensitive member) or fall off (leak). The migration of the magnetic particles to the photosensitive member or the falling off of the magnetic particles deteriorates the contact between the magnetic brush and the photosensitive member, resulting in poor charging.

It is therefore preferable that the charging member is provided with insulating members in the end areas in the longitudinal direction of the charging member (hereinafter referred to as the end processing). The present invention is very suitable for the end processing, and provides noticeable effects.

This is because the magnetic particles used for the present invention can prevent abrasion of the processing portion, especially when the processing portion is formed of resin.

Examples of end processing means are explained in detail referring to FIGS. 3 through 10.

Figure 3:
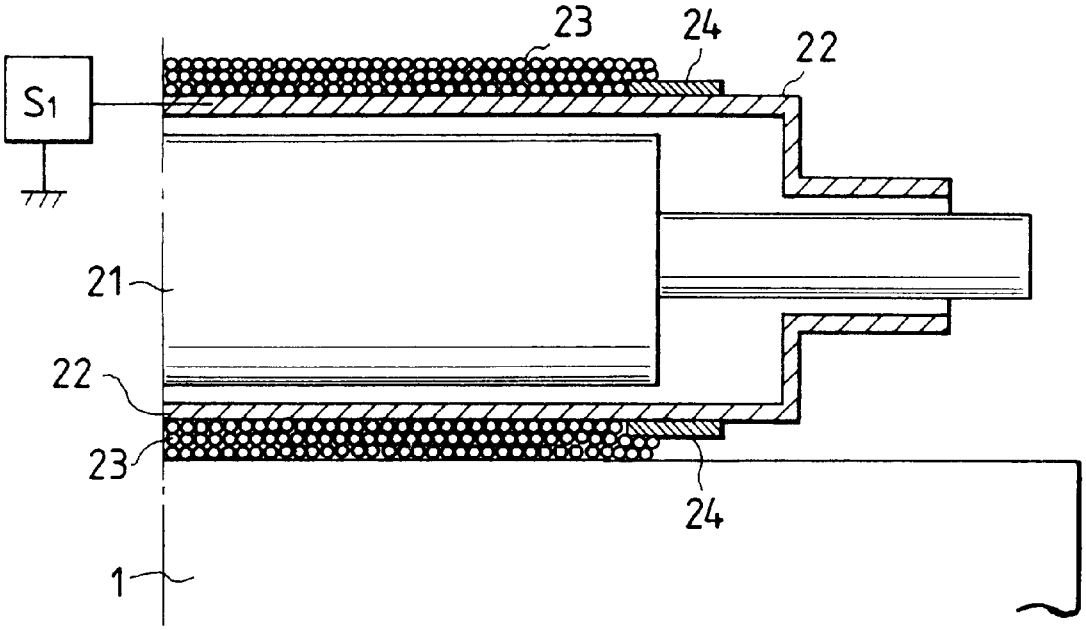
FIG. 3 shows an example of end processing means for a charging member.

(1) As is shown in FIG. 3, a ring-shaped insulator 24 is formed on the surface of an electrode sleeve 22 at each end portion in the longitudinal direction. The rotatable electrode sleeve 22 internally contains a magnet roll 21.

According to this constitution, the conductivity channel from the sleeve 22 to magnetic particles 23 is cut off, and no electric charges are injected into the magnetic particles 23 at the end portion where the contact with a photosensitive member 1 becomes non-uniform. Further, the electric field which causes attachment does not act on the magnetic particles 23 at that portion, the adhesion of the magnetic particles 23 to the photosensitive member 1 can be prevented.

The insulator 24 can be a polyester resin, a nylon resin, a silicone resin, a fluorine resin, an acrylic resin, an urethane resin, a phenol resin, a polyolefin resin, or a polycarbonate resin. Such a resin is applied directly, or formed into a film or a cap to be adhered using an adhesive. Otherwise, the insulator 24 can be formed by applying a tube made of styrene, urethane, polyamide, olefin, or fluorine elastomer, with pressure or heat-shrinkage.

Figure 4:
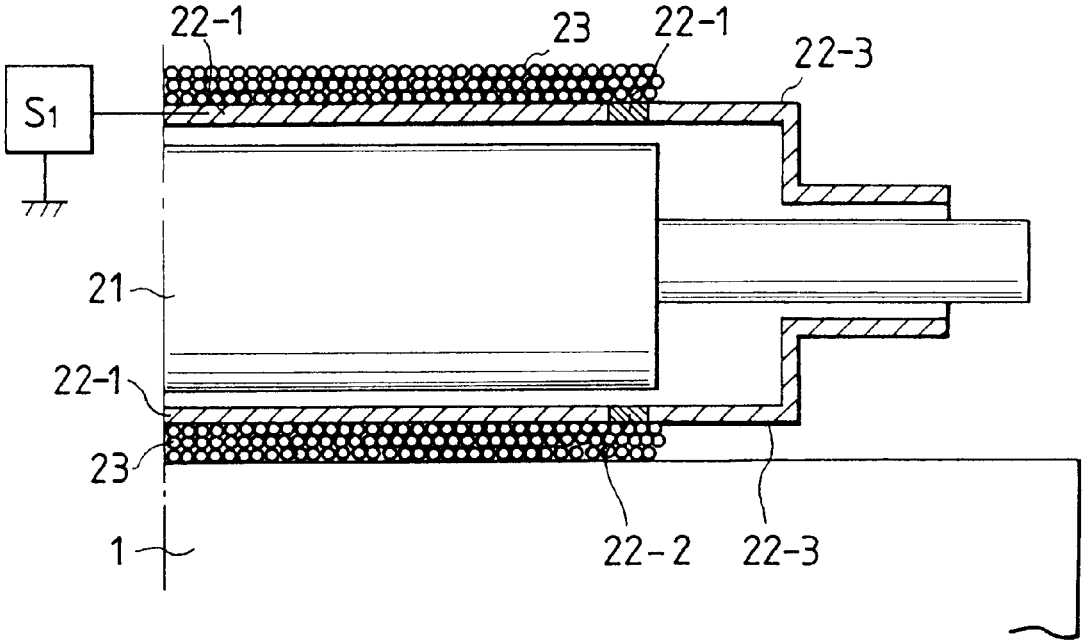
FIG. 4 shows an example of end processing means for a charging member.

(2) As is shown in FIG. 4, a float electrode 22-3 is provided in an area that corresponds to the peripheral end of the magnetic brush on an electrode sleeve 22-1.

More specifically, the float electrode 22-3, the second electrode sleeve, is comprised of a sleeve-like structure made of a conductive material, and is fixed to the electrode sleeve 22-1 with an intervening insulating spacer 22-2. The float electrode 22-3 may be made of a resin dispersed with a metal such as aluminum, SUS and copper, or conductive particles.

The material used for the insulating spacer 22-2 can be a polyester resin, a nylon resin, a silicone resin, a fluorine resin, an acrylic resin, an urethane resin, a phenol resin, a polyolefin resin, or a polycarbonate resin.

With this constitution, the potential of the magnetic particles 23 at the peripheral of the magnetic brush becomes the same as that of the photosensitive member 1 because of the action of the float electrode 22-3, so that no electric charges are injected into the magnetic particles 23. As a result, the attachment of the magnetic particles 23 to the photosensitive member 1 can be prevented.

Figure 5:
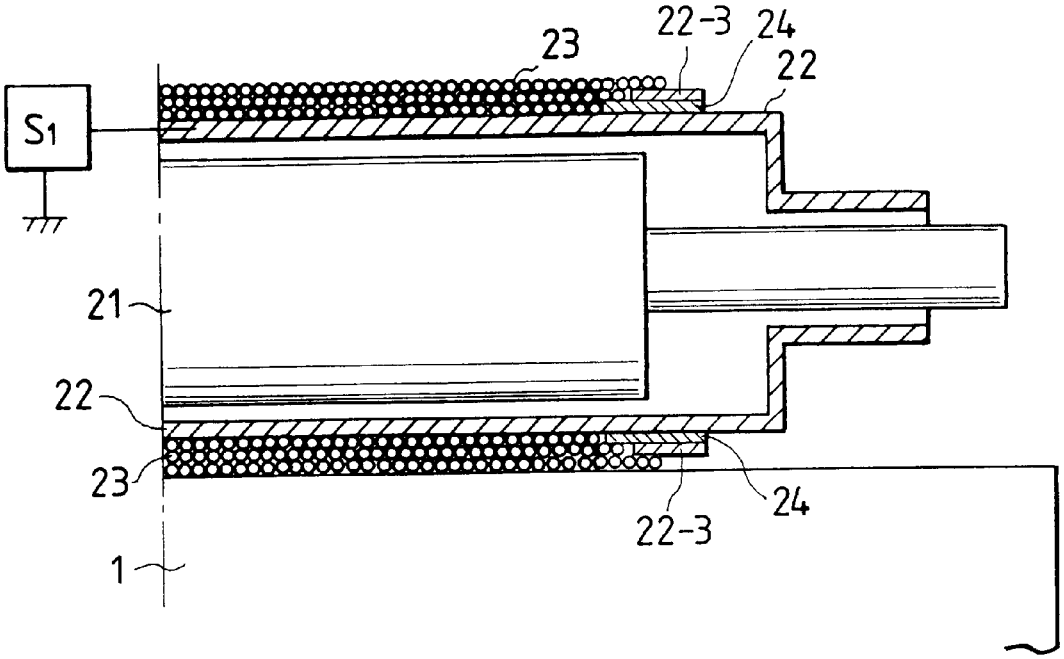
FIG. 5 shows an example of end processing means for a charging member.

Further, in this invention, as is shown in FIG. 5, the float electrode 22-3 can be provided on the surface of the ring-shaped insulator 24 described in (1).

Figure 6:
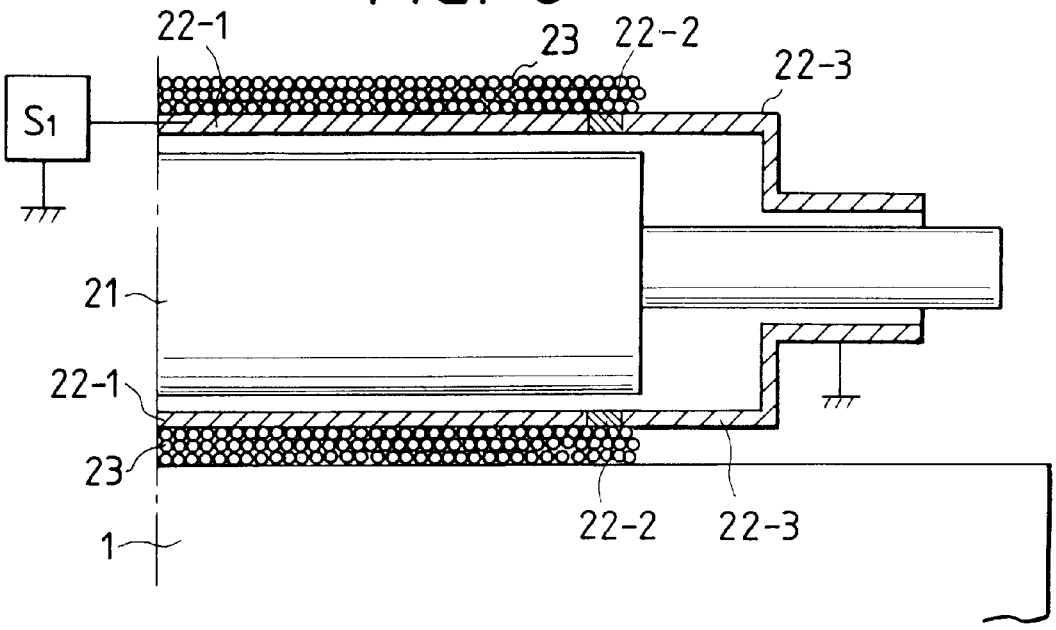
FIG. 6 shows an example of end processing means for a charging member.
Figure 7:
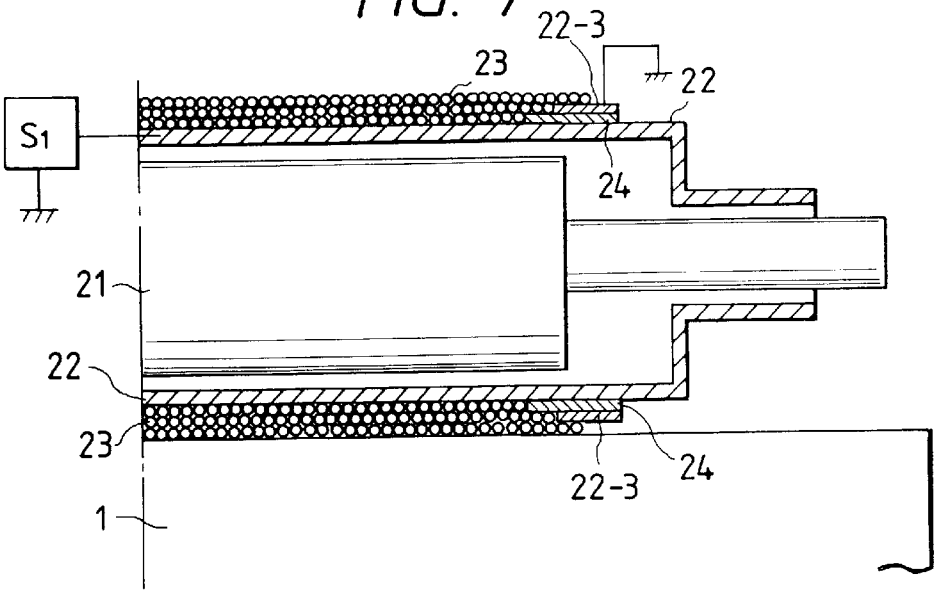
FIG. 7 shows an example of end processing means for a charging member.

(3) As is shown in FIGS. 6 and 7, the float electrode 22-3 corresponding to the peripheral end of the magnetic brush shown in (2) is grounded.

Specifically, the float electrode 22-3 is grounded in common with a photosensitive member earth.

By grounding the end, the potential of the magnetic brush 23 is decreased toward the end, and finally, becomes the same as the photosensitive member earth. Therefore, the difference between the potentials of the magnetic brush 23 and the photosensitive member 1 where the brush 23 does not contact can be prevented for a long period of time.

This constitution is an especially effective means for an AC superimposing charging method, where a greater potential difference exists between the charging member and the photosensitive member compared with the DC voltage charging method.

The AC superimposing charging method is not only widely employed in the conventional electrophotographic process, but in the cleaner-less process that does not require a cleaning device to remove the residual toner from the surface of the photosensitive member to suppress the influence exerted by remaining toner. This constitution of the charging member is also effective as the contact charging device for the cleaner-less process.

Figure 8:
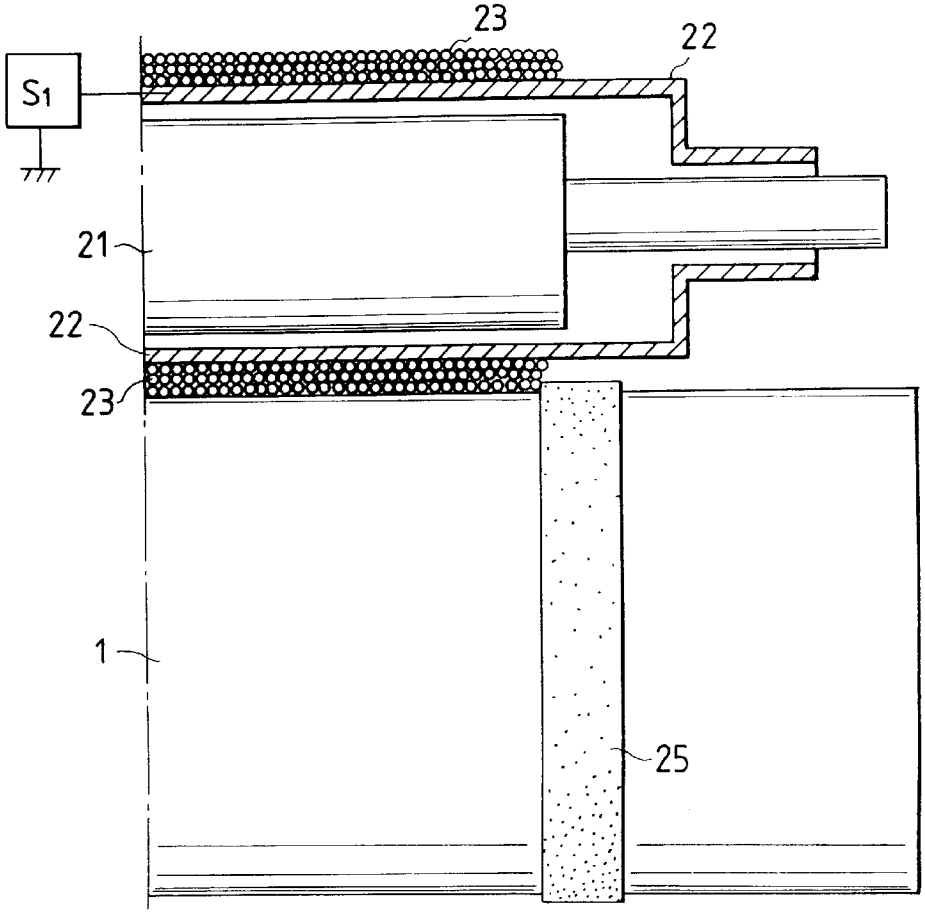
FIG. 8 shows an example of end processing means for a charging member.

(4) As is shown in FIG. 8, an electrode (conductive member) 25 is formed on the surface of the photosensitive member 1 at a position that corresponds to the peripheral end of the magnetic brush in the end of the longitudinal direction of the photosensitive member 1.

The electrode 25 contacts the end of the magnetic brush 23, and its potential becomes the same as that of the electrode sleeve 22. Therefore, even when the magnetic particles 23 are pushed out toward the end portion at the charging nip, no electric charges are injected into the magnetic particles 23, and no electric force acts on them, so that the attachment of the magnetic particles to the photosensitive member can be prevented.

Figure 9:
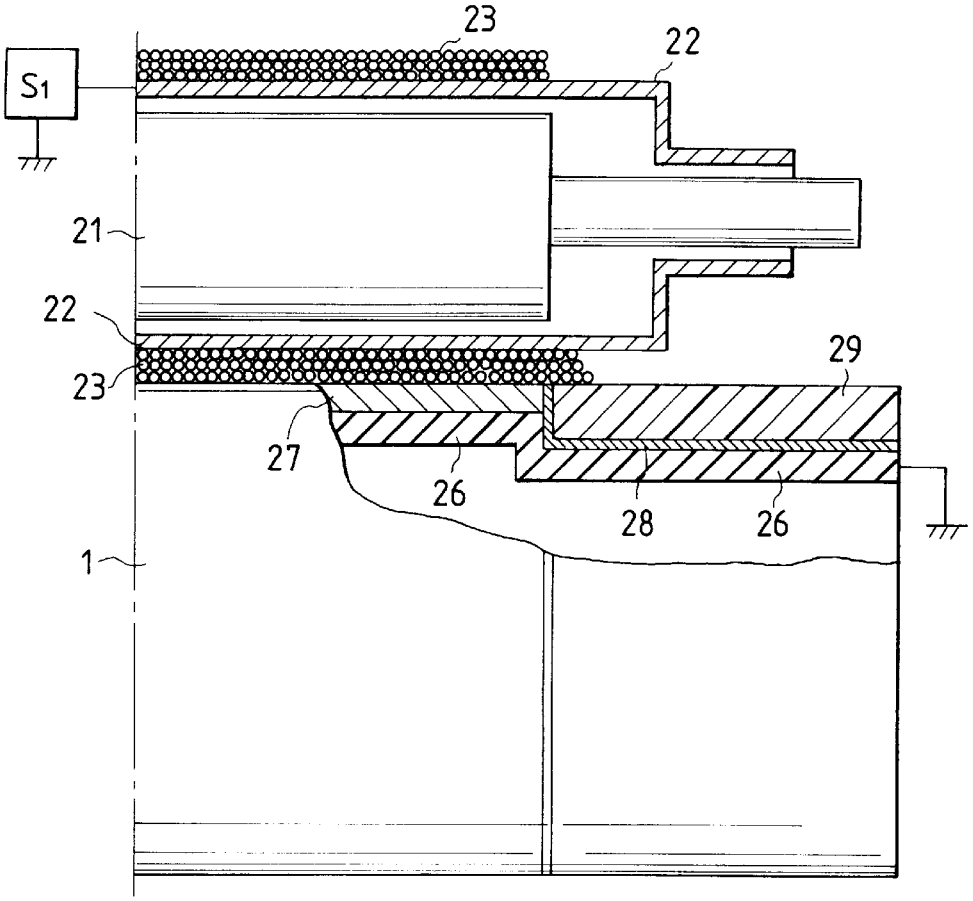
FIG. 9 shows an example of end processing means for a charging member.

(5) As is shown in FIG. 9, a floating electrode (conductive member) 29 that is insulated from the support of the photosensitive member 1 is provided at a position that corresponds to the end of the magnetic brush in the longitudinal direction of the photosensitive member 1. Reference numeral 28 denotes an insulating layer.

With this structure, the potential of the electrode 29 becomes the same as that of the magnetic brush 23, and the attachment of the magnetic particles 23 to the photosensitive member 1 can be prevented.

Figure 10:
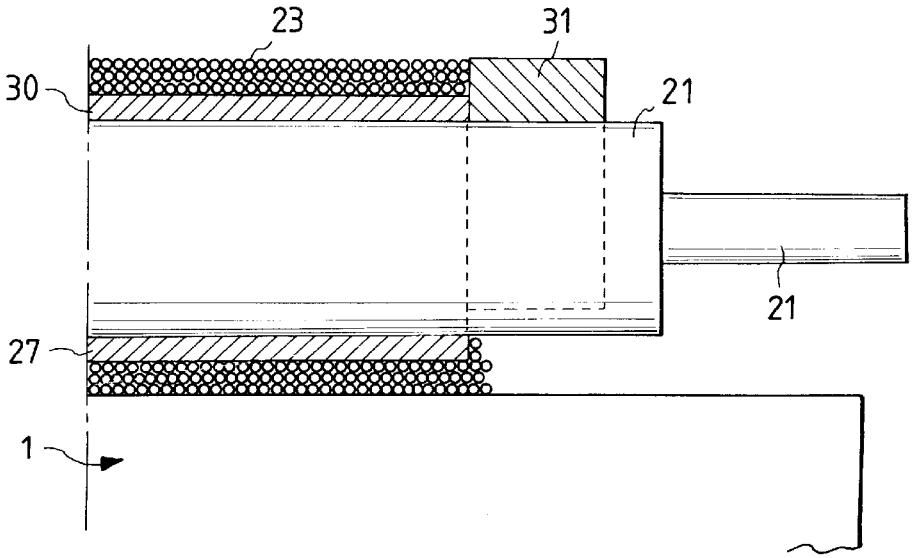
FIG. 10 shows an example of end processing means for a charging member.

(6) As is shown in FIG. 10, as one structure of a charging device, magnetic particles are directly attached to a rotatable magnet roll 21 having multiple poles to form a magnetic brush.

Since the magnetic particles 23 are directly attached to the surface of the magnet roll 21, the constraining force on the magnetic particles is increased to prevent the attachment of the particles to the photosensitive member.

With this constitution, the surface of the magnet roll may be processed (conductive processing 30) so as to apply a voltage to the magnetic particles 23. The conductive processing area is defined to either end of the magnetic brush 23, and at each end may be confined (insulated) by a sealing member 31. Even when the magnetic brush 23 spreads beyond the conductive processing area, the electric charge transfer channel is cut off, so that no electric charges are injected into the magnetic particles 23 and the attachment of the magnetic particles 23 to the photosensitive member 1 is prevented.

The conductive processing area 30 may be formed by a resin layer wherein the above described conductive particles are dispersed, by vacuum deposition of a metal, or by wrapping a metal foil.

The electrophotographic photosensitive member used in the present invention will now be described.

When the charging apparatus of the present invention is used for injection charging, the photosensitive member should have a charge injection layer as the farthest layer from the support member, i.e. a surface layer. It is desirable that the volume resistance of the charge injection layer is preferably $1\times10^{8}$ to $1\times10^{15}$ Ω cm in order to acquire sufficient electrification and to avoid smeared images. In particular, the volume resistance of $1\times10^{10}$ to $1\times10^{14}$ Ω cm is more preferable from the viewpoint of prevention of smeared images, and when environmental fluctuation of the volume resistance is considered, $1\times10^{12}$ to $1\times 10^{14}$ Ω cm is still more preferable. When the volume resistance is less than $1\times10^{8}$ Ω cm, it is difficult to hold electric charges in the surface direction under humid conditions, so that smeared images tend to be produced. When the volume resistance exceeds $1\times10^{15}$ Ω cm, the electric charges from the charging member can not be fully injected and held, so that charging failures tend to occur.

In the present invention, the volume resistance of a charge injection layer is measured as follows; a surface layer is formed on a gold-deposited polyethylene terephthalate (PET) film, and its volume resistance is measured using a volume resistance measurement device (4140B pA MATER produced by Hewlett Packard Co.) applying a voltage of 100 V to the surface layer, in an environment of temperature 23° C. and relative humidity 65%.

By employing the charging apparatus of the present invention and the above described photosensitive member, the charging threshold voltage Vth is small, and the photosensitive member can be charged to the potential corresponding to almost 90% or more of the voltage applied to the charging member.

For example, when a DC voltage having an absolute value of 100 to 2000 V is applied to the charging apparatus of the present invention, at a processing speed of 1000 mm/min or less, the charge potential of the electrophotographic photosensitive member having an charge injection layer becomes 80% or more of the applied voltage, or further, can be 90% or more. On the other hand, by a conventional discharge charging method, the potential of the photosensitive member is almost 0 V when the applied voltage is 640 V or less, and with the applied voltage of higher than 640 V, the obtained potential nearly corresponds to the applied voltage from which 640 V is subtracted.

The charge injection layer may be an inorganic layer such as a metal deposition film or a resin layer wherein conductive particles are dispersed in a binder resin. The former is formed by vacuum deposition, and the latter is formed by an appropriate coating method such as dip coating, spray coating, roll coating, and beam coating. The charge injection layer may be also formed by mixing or copolymerizing a light transmitting resin of high ion conductivity in an insulating binder resin, or may be a single resin having an intermediate resistance and a photoconductivity.

For the resin layer consisting of conductive particles and a binder resin, the binder resin can be a polyester resin, a polycarbonate resin, a polystyrene resin, a fluorine resin, a cellulose, a vinyl chloride resin, a polyurethane resin, an acrylic resin, an epoxy resin, a silicone resin, an alkyd resin, or a vinyl chloride-vinyl acetate copolymer resin. The conductive particles can be a metal such as copper, aluminum, sliver or nickel; an metal oxide such as zinc oxide, tin oxide, antimony oxide, titanium oxide, a solid solution or fusion substance thereof; or conductive polymer such as polyacetylene, polythiophene, or polypyrrole. From the viewpoint of transmittancy of the photosensitive member, a metal oxide of high transparency such as tin oxide is preferable. From the viewpoint of transmittancy, the desirable diameter of the conductive particles is 0.3 $\mu$m or smaller, and most preferably 0.1 $\mu$m or less. The content of the conductive particles in the charge injection layer preferably falls within a range of from 2 to 280 weight % of the binder resin, though it varies depending on the diameter of the particles. If the content is less than 2 weight %, the resistance of the charge injection layer is difficult to control. When the content exceeds 280 weight %, the film properties of the binder resin may partially deteriorate.

It is possible to use the same binder resin for the charge injection layer and for the underlayer, but the coating method should be chosen carefully, since the surface of the a charge transporting layer may be disturbed while the charge injection layer is formed on it.

Various additive agents can be added in order to improve the dispersion of the conductive particles and to enhance the adhesiveness of the binder resin, or the smoothness of the coated film. Especially for the improvement of dispersion, the surface modification of the conductive particles using a coupling agent or a leveling agent is very effective. Further, for the dispersion improvement, a curable resin is effectively used as the binder resin.

When a curable resin is used for the charge injection layer, the conductive particles are dispersed in a solution of curable monomer or oligomer, and the obtained coating liquid is applied to the photosensitive layer to form a film. The film is then cured by heating or by light irradiation to provide the surface layer. The curable resin includes an acrylic resin, an epoxy resin, a phenol resin or a melamine resin, but not limited to these examples. Any resin curable by chemical reaction initiated by a given energy such as light or heat can be employed.

The electric charge injection layer is preferably 0.1 to 10 $\mu$m, and more preferably 0.5 to 5 $\mu$m thick.

The charge injection layer may contain a lubricant powder. The friction between the photosensitive member and the charging member, or the friction between the photosensitive member and the cleaning member is reduced, and the dynamic load on the electrophotographic apparatus can be reduced. Further, the releasability of the photosensitive member is improved to prevent the attachment of the developing particles (toner) thereto. As a desirable lubricant powder, included are fluorine resins, silicone resins, and polyolefin resins all having a low critical surface tension, but tetrafluoroethylene is most preferred. In this case, the amount of the lubricant is preferably 2 to 50 weight % to the binder resin, and more preferably, 5 to 40 weight %. When the lubricant powder content is insufficient, less than 2 weight %, improvement of charging is not satisfactory. When the lubricant content exceeds 50 weight %, the resolution of images and the sensitivity of the photosensitive member tend to be degraded.

The charge injection layer made of an inorganic material can be a semiconductor such as amorphous silicon.

The silicon photosensitive member can be produced sequentially, using photoconductive amorphous silicon for the photosensitive layer, which is then subjected to high frequency glow discharge degradation by means of a plasma chemical vapor deposition device.

The photosensitive layer in the present invention is formed by the lamination of a charge generation layer and a charge transport layer. The photosensitive layer also can be formed as a single layer composed of a charge generation material and an electric charge transport material. The thickness of the charge transport layer is 5 to 40 $\mu$m, and the thickness of the charge generation layer is 0.05 to 5 $\mu$m.

The material for photosensitive layer is, for example, an organic material such as a phthalocyanine pigment or an azo pigment, or an inorganic material such as a silicon compound.

Further, an interlayer can be provided between the charge injection layer and the photosensitive layer. The interlayer improves the adhesiveness of the charge injection layer and the photosensitive layer, or serves as a charge barrier layer. For the interlayer, for example, a resin material such as epoxy resins, polyester resins, polyamide resins, polystyrene resins, acrylic resins, and silicone resins is usable.

As a conductive support for a photosensitive member in the present invention, a metal such as aluminum, nickel or stainless steel, a plastic or glass having a conductive film thereon, or conductive paper.

PREPARATION EXAMPLES OF MAGNETIC PARTICLES

Magnetic Particles Manufacturing Example 1

According to the method disclosed in Japanese Patent Application Laid-Open No. 60-106808 and No. 60-106809, with modified polymerization conditions such as the amount of catalyst and reaction time, a polyethylene resin layer was formed by direct polymerization on the surfaces of Cu—Zn ferrite magnetic particles (average particle diameter of 27 $\mu$m). Thus, magnetic particles 1 having a volume resistance of $7\times10^7$ $\Omega$ cm were obtained. In the molecular weight distribution of the resin layer, the main peak was present at the molecular weight of 95,000, the shoulder at the molecular weight of 5,000, Mn=10,000, Mw=285,000, and Mw/Mn=28.5.

Magnetic Particle Manufacturing Examples 2 to 4

According to the same method as was employed in the magnetic particle manufacturing example 1, the polymerization conditions such as the amount of catalyst and the reaction time were modified to obtain the magnetic particles shown in Table 1.

Concerning the magnetic particles 2 and 3, carbon black was added during polymerization as the conductive particles in the surface layer to control resistance.

Magnetic Particle Manufacturing Example 5

In 100 parts by weight of hot xylene, 0.1 part by weight of a polyethylene resin having a peak molecular weight of 7,000, and 0.9 part by weight of a polyethylene resin having a peak molecular weight of 130,000 were added, and mixed to provide a surface layer coating solution. The mixed resins as a whole had Mn of 15,000, Mw of 390,000, and Mw/Mn of 26.0. The solution was applied on Cu—Zn ferrite magnetic particles (average particle diameter of 24 $\mu$m) by using a spira coater, providing magnetic particles 5 having a volume resistance of $7\times10^7$ Ω cm.

Magnetic Particle Manufacturing Example 6

To provide magnetic particles 6 having a volume resistance of $9\times10^7$ Ω cm, the same method as in the manufacturing example 5 was used except that polyethylene resin had the following molecular weight distribution. Peak molecular weight=35,000, Mn=7,000, Mw=110,000, Mw/Mn=15.7.

Magnetic Particle Manufacturing Example 7

Magnetic particles 7 having a volume resistance of $1\times10^7$ cm were produced in the same manner as in the magnetic particle manufacturing example 5, except that the coating solution was made by dispersing conductive carbon in a mixture of 0.1 part by weight of a polyethylene having a peak molecular weight of 5,000 and 0.9 part by weight of a polyethylene resin having a peak molecular weight of 110,000. For the mixed resin, Mn=14,500, Mw=383,000 and Mw/Mn=26.4.

Magnetic Particle Manufacturing Example 8

In a 500 ml flask flashed with argon, 100 ml of refined n-heptane, 10 g of stearic acid magnesium and 0.33 g of titanium tetrachloride were placed. The mixture was heated and refluxed for two hours to obtain a titanium-containing catalyst.

Separately, 1,000 ml of refined n-heptane, 600 g of Cu—Zn ferrite powder that had been desiccated at 150° C. under reduced pressure having an average diameter of 25 $\mu$m and a volume resistance of $1\times10^5$ Ω cm, and 0.3 g of a titanium-containing catalyst (corresponding to 0.05 millimole) were mixed together in a 3000 ml flask. The mixture were then heated and refluxed for one hour to provide a mixture 8.

The mixture 8 was put into a 3,000 ml autoclave flashed with argon, and refined n-heptane was added to 1,500 ml. Thereafter, 5 millimole of triethylaluminium and 5 millimole of diethylaluminium monochloride were added to the above mixture. The resultant mixture was heated at 80° C., and hydrogen was supplied thereto to make the pressure to 3 kb/cm$^2$G, and the polymerization reaction was carried out for 10 minutes while ethylene gas was continuously supplied to maintain the pressure at 7 kg/cm$^2$G. Then polyolefin resin-coated magnetic particles 8 having a volume resistance of $8\times10^6$ Ω cm were obtained. The weight-average molecular weight Mw of polyolefin on the surface of the magnetic particles was 170,000.

Magnetic Particle Manufacturing Example 9

The synthesis was performed with the same method as that in the manufacturing example 8, except that the monomer was a monomer composition of ethylene/propylene=9:1. As a result, polyolefin-coated magnetic particles 9 having a volume resistance of $7\times10^6$ Ω cm were obtained.

Magnetic Particle Manufacturing Example 10

In a 3000 ml flask, 1,000 ml of refined n-heptane, 600 g of Cu—Zn ferrite powder that had been desiccated at 150° C. under a reduced pressure and had a diameter of 25 $\mu$m and a volume resistance of $1\times10^5$ Ω cm, 0.3 g of carbon black, and 0.6 g ( 0.1 millimole) of the titanium-containing catalyst used in the manufacturing example 8 were placed. The resultant mixture was heated and refluxed for one hour to provide a mixture 10.

The mixture 10 was put in a 3,000 ml autoclave flashed with argon, and refined n-heptane was added to make the total volume 1,500 ml. Thereafter 10 millimole of triethylaluminium and 10 millimole of diethylaluminium monochloride were added to the mixture. The resultant mixture was heated to 80° C. and hydrogen was supplied to make the pressure 4 kb/cm$^2$G, and polymerization reaction was performed for 30 minutes while ethylene gas was continuously supplied to maintain the pressure at 9 kg/cm$^2$G. Then polyolefin resin-coated magnetic particles 10 having a volume resistance of $2\times10^6$ Ω cm were obtained. The weight-average molecular weight Mw of polyolefin on the surface of the magnetic particles was 250,000.

Magnetic Particle Manufacturing Example 11

The same method was used as in the manufacturing example 10, except that the monomer was a monomer composition of ethylene/propylene=9:1. As a result, polyolefin-coated magnetic particles 11 having a volume resistance of $1\times10^6$ Ωcm were obtained.

Magnetic Particle Manufacturing Example 12

In 400 parts of a solution of a low-density polyethylene resin in xylene (0.5 weight % of solid polyethylene resin, weight-average molecular weight 50,000), 0.2 part of carbon black was dispersed. The polyethylene resin in which the carbon black was dispersed was applied to 100 parts of the ferrite powder used in the manufacturing example 8 by employing a spira coater (produced by Okada Seiko Co., Ltd.). As a result, polyolefin coated magnetic particles 12 having a volume resistance of $3\times10^6$ Ω cm were obtained.

Magnetic Particle Manufacturing Example 13

The same process was used as in the manufacturing example 10, except that 600 g of Cu—Zn ferrite powder having an average diameter of 25 $\mu$m and a volume resistance of $4\times10^6$ Ωcm was employed. As a result, polyolefin coated magnetic particles 13 having a volume resistance of $7\times10^7$ Ω cm were obtained.

Magnetic Particle Manufacturing Example 14

The same process was used as in the manufacturing example 10, except that 600 g of Cu—Zn ferrite powder having an average diameter of 80 $\mu$m and a volume resistance of $5\times10^6$ Ω cm was employed. As a result, polyolefin coated magnetic particles 14 having a volume resistance of $8\times10^7$ Ω cm was obtained.

Magnetic Particle Manufacturing Example 15

The same process was used as in the manufacturing example 8, except that 600 g of Cu—Zn ferrite powder having an average diameter of 80 μm and a volume resistance of $8\times10^8$ Ω cm was employed and that the polymerization reaction time was 30 minutes. As a result, polyolefin coated magnetic particles 15 having a volume resistance of $4\times10^{11}$ cm was obtained.

Magnetic Particle Manufacturing Example 16

The Cu—Zn ferrite powder, used in the manufacturing example 13, having a volume resistance $4\times10^6$ Ω cm was made the magnetic particles 16 without coating.

Magnetic Particle Manufacturing Example 17

The Cu—Zn ferrite powder, used in the manufacturing example 15, and having a volume resistance $8\times10^8$ Ω cm was made the magnetic particles 17 without coating.

Magnetic Particle Manufacturing Example 18

The magnetite powder having an average diameter of 25 μm and a volume resistance $7\times10^3$ Ω cm was made to be magnetic particles 18 without coating.

Magnetic Particle Manufacturing Example 19

The same process was used as in the manufacturing example 12, except that the weight-average molecular weight Mw of the polyethylene resin was 10,000. As a result, polyolefin-coated magnetic particles 19 having a volume resistance of $4\times10^8$ Ω cm were obtained.

Magnetic Particle Manufacturing Example 20

In a 500 ml flask flashed with argon, 100 ml of refined n-heptane, 10 g of stearic acid magnesium and 0.33 g of titanium tetrachloride were placed. The mixture was heated and refluxed for two hours to provide a titanium-containing catalyst.

Separately, 1,000 ml of refined n-heptane, 600 g of Cu—Zn ferrite powder that had been desiccated at 150° C. under a reduced pressure and had an average diameter of 25 μm and a volume resistance of $1\times10^5$ Ωcm, and 0.3 g of a titanium-containing catalyst (0.05 millimole) were mixed together in a 3000 ml flask. The mixed substance was heated and refluxed for one hour to provide a mixture 20.

The mixture 20 was put in a 3,000 ml autoclave flashed with argon, and refined n-heptane was added thereto to make the volume to 1,500 ml. Thereafter, 5 millimole of triethylaluminium and 5 millimole of diethylaluminium monochloride were added to the above mixture. The resultant mixture was heated to 80° C. and hydrogen was supplied thereto to make the pressure up to 3 kb/cm$^2$G, and polymerization reaction was performed for thirty minuets while ethylene gas was continuously supplied to maintain the pressure at 7 kg/cm$^2$G. As a result, polyolefin resin coated magnetic particles 20 having a volume resistance of $6\times10^{10}$ Ω cm were obtained. 0.1 part by weight of carbon black was dry-dispersed in 100 parts by weight of the polyolefin magnetic particles, and carbon black was mechanochemically fixed on the particle surface using a hybridizer (a product of Nara Kikai Co.). The volume resistance of the resultant magnetic particles was $5\times10^6$ Ω cm, and the weight-average molecular weight Mw of polyolefin on the surface of the magnetic particles was 220,000.

Magnetic Particle Manufacturing Example 21

The same process was used as in the manufacturing example 12 except that the weight-average molecular weight Mw of the polyethylene resin was 5,000. As a result, polyolefin coated magnetic particles 21 having a volume resistance of $5\times10^6$ Ω cm were obtained.

Magnetic Particle Manufacturing Example 22

The same process was used as in the manufacturing example 8 except that the reaction conditions were changed. Polyolefin-coated magnetic particles 22 having a volume resistance of $3\times10^6$ Ω cm were obtained.

TABLE 1

| | | Peak | | | | | Resistance | Formation | Average Particle diameter |
|---|---|---|---|---|---|---|---|---|---|
| | Mw | P1 | P2 | Mn | Mw/Mn | Mz | (Ω · cm) | Method | (μm) |
| Magnetic Particle Manufacturing Example 1 | 285,000 | 95,000 | 5,000 | 10,000 | 28.5 | 3,200,000 | $7\times10^7$ | Direct Polymerization | 27 |
| Magnetic Particle Manufacturing Example 2 | 265,000 | 85,000 | 4,000 | 9,500 | 27.9 | 2,800,000 | $1\times10^7$ | Direct Polymerization | 24 |
| Magnetic Particle Manufacturing Example 3 | 295,000 | 98,000 | 6,000 | 12,000 | 24.6 | 4,100,000 | $3\times10^7$ | Direct Polymerization | 30 |
| Magnetic Particle Manufacturing Example 4 | 230,000 | 80,000 | 3,500 | 8,500 | 27.1 | 2,300,000 | $5\times10^8$ | Direct Polymerization | 35 |
| Magnetic Particle Manufacturing Example 5 | 390,000 | 130,000 | 6,000 | 15,000 | 26.0 | 1,100,000 | $7\times10^7$ | Coating | 24 |
| Magnetic Particle Manufacturing Example 6 | 110,000 | 35,000 | — | 7,000 | 15.7 | 1,300,000 | $9\times10^7$ | Coating | 24 |
| Magnetic Particle Manufacturing Example 7 | 383,000 | 110,000 | 4,000 | 14,500 | 26.4 | 1,500,000 | $1\times10^7$ | Coating | 27 |
| Magnetic Particle Manufacturing Example 8 | 170,000 | 50,000 | 5,000 | 8,000 | 21.3 | 1,300,000 | $8\times10^6$ | Direct Polymerization | 25 |
| Magnetic Particle Manufacturing Example 9 | 180,000 | 60,000 | 5,000 | 8,000 | 22.5 | 1,300,000 | $7\times10^6$ | Direct Polymerization | 25 |
| Magnetic Particle Manufacturing Example 10 | 250,000 | 80,000 | 5,000 | 8,500 | 29.4 | 1,800,000 | $2\times10^6$ | Direct Polymerization | 25 |
| Magnetic Particle Manufacturing Example 11 | 240,000 | 80,000 | 5,000 | 8,500 | 28.2 | 1,800,000 | $1\times10^6$ | Direct Polymerization | 25 |
| Magnetic Particle Manufacturing Example 12 | 50,000 | 15,000 | — | 3,000 | 16.7 | 500,000 | $3\times10^6$ | Coating | 25 |

TABLE 1-continued

| | Mw | Peak P1 | Peak P2 | Mn | Mw/Mn | Mz | Resistance (Ω · cm) | Formation Method | Average Particle diameter (μm) |
|---|---|---|---|---|---|---|---|---|---|
| Magnetic Particle Manufacturing Example 13 | 250,000 | 80,000 | 5,000 | 8,000 | 31.3 | 1,900,000 | $7 \times 10^7$ | Direct Polymerization | 25 |
| Magnetic Particle Manufacturing Example 14 | 260,000 | 80,000 | 5,000 | 8,000 | 32.5 | 2,000,000 | $8 \times 10^7$ | Direct Polymerization | 80 |
| Magnetic Particle Manufacturing Example 15 | 160,000 | 50,000 | 5,000 | 8,000 | 20.0 | 1,400,000 | $4 \times 10^{11}$ | Direct Polymerization | 80 |
| Magnetic Particle Manufacturing Example 16 | — | — | — | — | — | — | $4 \times 10^6$ | Unformed | 25 |
| Magnetic Particle Manufacturing Example 17 | — | — | — | — | — | — | $8 \times 10^8$ | Unformed | 80 |
| Magnetic Particle Manufacturing Example 18 | — | — | — | — | — | — | $7 \times 10^3$ | Unformed | 25 |
| Magnetic Particle Manufacturing Example 19 | 10,000 | 5,000 | — | 2,000 | 5.0 | 90,000 | $4 \times 10^8$ | Coating | 25 |
| Magnetic Particle Manufacturing Example 20 | 220,000 | 70,000 | 6,000 | 8,000 | 27.5 | 2,500,000 | $5 \times 10^6$ | Direct Polymerization | 25 |
| Magnetic Particle Manufacturing Example 21 | 5,000 | 3,000 | — | 1,500 | 3.3 | 60,000 | $5 \times 10^6$ | Coating | 25 |
| Magnetic Particle Manufacturing Example 22 | 50,000 | 13,000 | — | 3,000 | 16.7 | 750,000 | $3 \times 10^6$ | Direct Polymerization | 25 |

Electrode Sleeve Manufacturing Example 1

Based on FIG. 3, the end processing was performed on the electrode sleeve 22. The polyester sheet 24 of 40 μm thick was bonded to the outer surface of the sleeve 22 near its each end which corresponds to the end of the magnet roller 21, with an adhesive. The sheet was 25 mm wide and the inner edge of the sheet was set 6 mm inside from the end of the magnetic brush in the longitudinal direction. The magnetic sleeve was an aluminum sleeve with an outer diameter of 16 mm containing a magnet roller inside. The resultant sleeve is defined as an electrode sleeve 1.

Electrode Sleeve Manufacturing Example 2

Based to FIG. 4, a sleeve-shaped float electrode 22-3 made of aluminum was fixed to the electrode sleeve intervened by an insulating spacer 22-2 made of Teflon resin. The insulating spacer 22-2 was 6 mm wide and was positioned inside from the end of the magnetic brush in the longitudinal direction. This is defined as an electrode sleeve 2.

Electrode Sleeve Manufacturing Example 3

An electrode sleeve 3 was prepared as in the electrode sleeve manufacturing example 1 except that an urethane resin in which carbon black was dispersed was applied on the surface of the polyester sheet (25 mm wide) was used to provide a float electrode portion (FIG. 5).

Electrode Sleeve Manufacturing Example 4

An electrode sleeve 4 was prepared as in the electrode sleeve manufacturing example 2, except that the float electrode 2 was grounded as is shown in FIG. 6, and that instead of Teflon resin, polycarbonate resin was used as an insulating spacer.

Electrode Sleeve Manufacturing Example 5

The float electrode in the electrode sleeve manufacturing example 3 was grounded as is shown in FIG. 7. This is defined as an electrode sleeve 5.

Electrode Sleeve Manufacturing Example 6

The electrode sleeve 1 without no end processing is defined as an electrode sleeve 6.

PHOTOSENSITIVE MEMBER MANUFACTURING EXAMPLES

Photosensitive Member Manufacturing Example 1

In the photosensitive member in the present invention, an organic photoconductive substance is used for negative charging, and the following layers were provided on a ϕ30 mm aluminum cylinder.

The first layer is a conductive layer, a resin layer of about 20 μm thick in which conductive particles are dispersed. This layer is provided in order to cover the defects on the aluminum cylinder and to prevent the moiré due to the reflection of an exposing laser beam.

The second layer is a prevention layer against the positive charge injection (subbing layer). It is about 1 μm thick and has an intermediate resistance adjusted to $10^6$ Ω cm by methoxy methylated nylon. This layer prevents the positive charges that are injected from the aluminum support from canceling the negative charges on the surface of the photosensitive member.

The third layer is a charge generation resin layer about 0.3 μm thick in which disazo pigment is dispersed, and generates positive and negative electric charge pairs with laser beam exposure.

The fourth layer, an electric charge transport layer about 25 μm thick, is composed of a polycarbonate resin in which hydrazone is dispersed, and is a P semiconductor. Therefore, negative charges on the surface of the photosensitive member can not pass through this layer, and only positive electric charges that are generated in the charge generation layer can be transported to the surface of the photosensitive member. Such a photosensitive member is defined as a photosensitive member 1.

Photosensitive Member Manufacturing Example 2

Based on FIG. 8, a conductive resin coating of 25 μm thick and 20 mm wide was applied on each position of the photosensitive member corresponding to each longitudinal end of the magnetic brush. The conductive resin was an acrylic resin in which carbon black had been dispersed. The resultant photosensitive member is defined as a photosensitive member 2.

Photosensitive Member Manufacturing Example 3

The photosensitive member of manufacturing example 1 was further provided with a charge injection layer on the surface of the fourth layer. The injection layer was made of a photosetting acrylic resin dispersed with $SnO_2$ superfine particles and tetrafluoroethylene resin particles having a diameter of about 0.25 μm.

More specifically, 100 weight % (based on the resin) of $SnO_2$ particles of a diameter of 0.03 μm that were doped with antimony to reduce resistance, 20% by weight of tetrafluoroethylene, and 1.2% by weight of a dispersion agent were dispersed in the acrylic resin. The resultant coating liquid was applied by spray coating to provide the electric charge injection layer of about 2.5 μm thick.

As a result, the resistance of the surface layer of the photosensitive member became $3\times10^{12}$ Ω cm, while the volume resistance was more than $1\times10^{15}$ Ω cm when only the charge transport layer was formed for the photosensitive member. This is defined as a photosensitive member 3.

Photosensitive Member Manufacturing Example 4

Based on FIG. 9, a functional layer 27 including the charge injection layer of the photosensitive member 3, was terminated at 6 mm inside the end of the magnetic brush in longitudinal direction, and an insulating polycarbonate layer 28 (100 μm) was formed outside the layer 27, on which layer 28 a polycarbonate resin layer 24 dispersed with tin oxide was provided as a float electrode. The near end portion of the cylinder was ground down by 1 mm smaller than the outer diameter (ϕ30) of the central portion. This is defined as a photosensitive member 4.

Photosensitive Member Manufacturing Example 5

A photosensitive member was produced in the same process as in the photosensitive member manufacturing example 3, except that the charge injection layer was produced without dispersing tetrafluoroethylene resin particles and a dispersion agent. The volume resistance of the surface layer of the photosensitive member was $1\times10^{12}$ Ω cm. This is defined as a photosensitive member 5.

Photosensitive Member Manufacturing Example 6

An amorphous silicon photosensitive member was produced by forming a prevention layer, a photoconductive layer and a surface layer were formed on a ϕ30 mm aluminum cylinder in this order by glow discharging. The surface of the aluminum cylinder had been mirror polished.

Specifically, air in a reaction chamber was evacuated to about $5\times10^{-3}$ Pa, and gases of $SiH_4$, $B_2H_6$, NO and $H_2$ were fed in flow into the reaction chamber to sweep the surface of the aluminum cylinder heated to 250° C. When the internal pressure reached 30 Pa, a glow discharge was started to form the prevention layer of 5 μm thick.

The same process was used as in the prevention layer formation, to form a photoconductive layer of 20 μm thick, employing $SiH_4$ and $H_2$ gases under an internal pressure of about 50 Pa.

Further, the surface layer of 0.5 μm thick was formed by glow discharge by using $SiH_4$, $CH_4$ and $H_2$ gases under an internal pressure of about 60 Pa, to complete the amorphous silicon photosensitive member. The surface resistance of the photosensitive member was $8\times10^{12}$ Ω cm. This is defined as a photosensitive member 6.

Photosensitive Member Manufacturing Example 7

Based on FIG. 9, a copper deposition film of 0.4 μm thick and 15 mm wide was formed on the photosensitive member 6 at each position that corresponded to the end of the magnetic brush in longitudinal direction. This is defined as a photosensitive member 7.

Photosensitive Member Manufacturing Example 8

A photosensitive member was produced in the same manner as in the photosensitive member manufacturing example 3, except that 300% by weight of $SnO_2$ having a diameter of about 0.03 μm, which had been doped with antimony to reduce resistance, was dispersed in a light-setting acrylic resin. The volume resistance of the surface layer of a thus produced photosensitive member was $2\times10^{7}$ Ω cm. This is defined as a photosensitive member 8.

Toner Manufacturing Example

| | |
|---|---|
| Polyester resin | 100 parts (by weight, the same applied hereinafter) |
| carbon black | 3 parts |
| chromium compound of di-tert-butyl salicylic acid | 4 parts |
| | 4 parts |

The above materials were sufficiently premixed using a henschel mixer, and the mixture was melted and mixed by means of a twin-screw extrusion kneader. After cooling, the mixture was crushed by a hammer mill to obtain particles of about 1 mm, and the crushed material was then pulverized by means of an air-jet pulverizer. The pulverized powder was air-classified to obtain black powder having weight-average particle diameter of 10 μm.

A hundred parts of the black powder and 1.5 parts of fine silica powder (average grain diameter of 0.05 μm) which surface had been treated for hydrophobicity, were mixed by a henschel mixer to obtain a toner.

Evaluation Conditions for Examples

An electrophotographic printer used in Examples is illustrated referring to FIG. 1. The processing speed was 100 mm/sec other than in Example 16 to 20. The photosensitive members used in Examples were those produced in the Photosensitive Member Manufacturing Examples.

Charging means 2 comprises a non-magnetic conductive sleeve (ϕ16 mm) having a blast-processed surface, and a magnet roll having a magnetic flux density of 0.1 T (tesla) mounted inside the sleeve, to bear ears of magnetic particles on the sleeve as a magnetic brush. The determined clearance between the charging member and the photosensitive member 1 was about 500 μm, and the magnetic particles obtained in one of the Magnetic Particle Manufacturing Examples were employed to coat the sleeve so as to form a charging nip about 5 mm wide between the magnetic particles and the photosensitive member. While the magnet roll was fixed, the sleeve surface was rotated at a speed 1.5 times the circumferential speed of the surface of the photosensitive member, in the opposite direction at the contact portion, so that the photosensitive member and the magnetic brush might contact each other uniformly.

It is not preferable to set the circumferential speed of the magnetic brush and that of the photosensitive member the same, because the magnetic brush not having physical restorability is once pushed away due to the vibration or the eccentricity of the photosensitive member, the charging nip can not be obtained and a charging failure may occur. Considering the above and that it is preferable that always a fresh face of the magnetic brush contact the photosensitive member, in these Examples, the charging apparatus was rotated in the opposite direction at the contact point and at a speed 1.5 times the photosensitive member was rotated.

Subsequently, the photosensitive member was subjected to image exposure at the exposure part. The exposure light 3 was, for example, a laser beam emitted from a laser diode, of which intensity had been modulated in accordance with the received image signals. An electrostatic latent image was formed on the photosensitive member by scanning with the laser beam using a polygon mirror.

Then, two-component development was carried out.

The carrier was a Cu—Zn ferrite carrier, having an average particle diameter of 35 $\mu$m and silicone resin coating. The toner used was the one obtained in the Toner Manufacturing Example. The toner and the carrier were mixed at a weight ratio of 5:100.

The developer layer was formed on the developer-carrying member 4 containing a magnet inside, using a non-magnetic stainless blade provided with a clearance of 500 $\mu$m in order to control the thickness of the developer layer.

In this condition, a voltage was applied to the toner carrying member by superimposing on a DC voltage of −500 V an AC voltage having a frequency of 2,000 Hz and a peak-to-peak voltage of 2.0 KV, to carry out two-component development between the developer-carrying member and the photosensitive member. The rotation speed of the stainless sleeve, i.e. the developer-carrying member, was set to twice that of the photosensitive member with the same direction at the facing portion.

The image that was developed with the toner was transferred to a transfer material 5. A transfer roller 6 having an intermediate resistance was employed as a transfer means. In Example 1, the resistance of the roller was $5\times10^8$ Ω cm, and the image transfer was performed upon application of a DC voltage of +2,500 V.

The transferred toner image on the transfer material was fixed by heat fixing rollers 7, and was discharged outside. The toner not transferred was scraped off from the surface of the photosensitive member by a cleaning blade 8.

Such an electrophotographic apparatus was employed to conduct the following evaluations. Three kind of voltage were used for voltage application to the electrode sleeve: an AC superimposing voltage (DC-700 V, 1.6 KVpp), a weak AC superimposing voltage (DC-700 V, 1.0 KVpp), and a DC voltage injection (DC-700 V), except for the photosensitive members 6 and 7 to which DC component of +500 V was applied.

Evaluation 1: Image formation (5,000 sheets and 10,000 sheets) was carried out to observe the leakage of the magnetic particles and their attachment to the photosensitive member. The four evaluation criteria were used as shown in Table 2.

TABLE 2

| Symbol | Degree of leakage or attachment to the drum |
|---|---|
| AA | No leakage or attachment<br>Good image quality |
| A | Slight attachment to the drum<br>No image quality deterioration |
| B | Partial leakage<br>Image quality deterioration |
| C | Charging failure occurred due to leakage and attachment. |

Evaluation 2: Using an electron microscope, enlarged photographs of the surface of the near end portions of the electrode sleeve and the photosensitive member were taken. The abrasion or peeling of the coated resin layer or of the float electrode was observed for evaluation. The four evaluation criteria are shown in Table 3.

TABLE 3

| Symbol | Degree of abrasion or peeling off of coated resin layer or float electrode |
|---|---|
| AA | No change |
| A | Scratch or deformation on only very limited part of coated resin layer or of outermost surface layer of float electrode |
| B | Partial peeling off of coated resin layer or float electrode |
| C | Notable peeling off of coated resin layer or float electrode |

TABLE 4

| | | | | | 5,000 sheets | | 10,000 sheets | |
|---|---|---|---|---|---|---|---|---|
| Example No. | Electrode Sleeve | Magnetic Particles | Photosensitive Member | Application Condition | Evaluation 1 | Evaluation 2 | Evaluation 1 | Evaluation 2 |
| 1 | 1 | 1 | 1 | AC Superimposing | A | AA | B | AA |
| 2 | 1 | 2 | 3 | DC injection | AA | AA | AA | AA |
| 3 | 2 | 3 | 6 | DC injection | A | AA | A | AA |
| 4 | 2 | 4 | 1 | AC Superimposing | AA | AA | B | AA |
| 5 | 3 | 1 | 3 | AC Superimposing | AA | AA | B | AA |
| 6 | 3 | 2 | 5 | Weak AC Superimposing | AA | AA | A | AA |
| 7 | 4 | 1 | 1 | AC Superimposing | AA | AA | B | AA |
| 8 | 4 | 3 | 3 | Weak AC Superimposing | AA | AA | A | AA |
| 9 | 5 | 1 | 1 | AC Superimposing | AA | AA | B | AA |
| 10 | 3 | 3 | 6 | DC injection | AA | AA | A | AA |

EXAMPLES 1 to 10

The respective combinations of the resin-coated magnetic particles, the electrode sleeves and the photosensitive members as shown Table 4 were evaluated according to evaluation 1 and evaluation 2 criteria. The results are shown in Table 4.

EXAMPLES 11–15

Using photosensitive members having end processing, respective combinations shown in Table 5 were studied and evaluated under Evaluation 1 and Evaluation 2 criteria. The results are shown in Table 5.

As is described above, according to the present invention, the leakage of the magnetic particles or their attachment to the photosensitive member, which causes deterioration of an image, were not observed, and preferable charging was maintained. The adhesiveness and abrasion resistance of the coated resin was also satisfactory. Wear of the end processing portion with use could be prevented.

Above all, the magnetic particles coated with a directly polymerized polyolefin resin having two peaks demonstrated a superior abrasion resistance in a durability test at a processing speed as high as 150 mm/sec.

TABLE 5

| | | | | | 5,000 sheets | | 10,000 sheets | |
|---|---|---|---|---|---|---|---|---|
| Example No. | Electrode Sleeve | Magnetic Particles | Photosensitive Member | Application Condition | Evaluation 1 | Evaluation 2 | Evaluation 1 | Evaluation 2 |
| 11 | 6 | 1 | 2 | AC Superimposing | A | AA | B | AA |
| 12 | 6 | 4 | 2 | AC Superimposing | A | AA | A | AA |
| 13 | 6 | 2 | 4 | Weak AC Superimposing | A | AA | A | AA |
| 14 | 6 | 3 | 4 | DC injection | A | AA | A | AA |
| 15 | 6 | 2 | 7 | DC injection | A | AA | A | AA |

EXAMPLES 16 to 20

The processing speed was changed from 100 mm/sec to 150 mm/sec, and the combinations shown in Table 6 was examined for Evaluation 1 and Evaluation 2. The results are shown in Table 6.

EXAMPLES 21 to 27

Evaluation 1 and Evaluation 2 were carried out on the combinations of resin coated magnetic particles, electrode sleeves and photosensitive members shown in Table 7. The results are shown in Table 7.

TABLE 6

| | | | | | 5,000 sheets | | 10,000 sheets | |
|---|---|---|---|---|---|---|---|---|
| Example No. | Electrode Sleeve | Magnetic Particle | Photosensitive Member | Application Condition | Evaluation 1 | Evaluation 2 | Evaluation 1 | Evaluation 2 |
| 16 | 4 | 1 | 3 | Weak AC Superimposing | AA | AA | A | AA |
| 17 | 4 | 2 | 3 | Weak AC Superimposing | AA | AA | A | AA |
| 18 | 4 | 3 | 3 | Weak AC Superimposing | AA | AA | A | AA |
| 19 | 4 | 4 | 3 | Weak AC Superimposing | AA | AA | A | AA |
| 20 | 4 | 22 | 3 | Weak AC Superimposing | AA | A | B | A |

TABLE 7

| Example No. | Electrode Sleeve | Magnetic Particle | Photosensitive Member | Application Condition | 5,000 sheets Evaluation 1 | 5,000 sheets Evaluation 2 | 10,000 sheets Evaluation 1 | 10,000 sheets Evaluation 2 |
|---|---|---|---|---|---|---|---|---|
| 21 | 1 | 5 | 1 | AC Superimposing | A | AA | B | AA |
| 22 | 1 | 7 | 3 | DC Injection | AA | AA | AA | AA |
| 23 | 2 | 6 | 6 | DC Injection | A | AA | A | AA |
| 24 | 2 | 7 | 1 | AC Superimposing | AA | AA | B | AA |
| 25 | 3 | 5 | 3 | AC Superimposing | AA | AA | B | AA |
| 26 | 3 | 7 | 5 | Weak AC Superimposing | AA | AA | A | AA |
| 27 | 4 | 7 | 1 | AC Superimposing | AA | AA | B | AA |

EXAMPLES 28 to 30

The photosensitive members having end processing was used, and Evaluation 1 and Evaluation 2 were carried out on the combinations shown in Table 8. The results are shown in Table 8.

TABLE 8

| Example No. | Electrode Sleeve | Magnetic Particle | Photosensitive Member | Application Condition | 5,000 sheets Evaluation 1 | 5,000 sheets Evaluation 2 | 10,000 sheets Evaluation 1 | 10,000 sheets Evaluation 2 |
|---|---|---|---|---|---|---|---|---|
| 28 | 6 | 5 | 2 | AC Superimposing | A | A | B | B |
| 29 | 6 | 6 | 4 | Weak AC Superimposing | A | AA | B | B |
| 30 | 6 | 7 | 7 | DC Injection | A | A | B | B |

According to the present invention, the leakage of the magnetic particles or their attachment to the photosensitive member resulting in the deterioration of the image quality, were not observed, and satisfactory charging was maintained. The adhesiveness of the coating resin was satisfactory, and above all, the abrasion resistance of the polyolefin resin was superior.

EXAMPLE 31

The electrophotographic apparatus as used in Example 1 was employed except that the electrode sleeve 6 was used, the circumferential speed of the of the sleeve was twice that of the photosensitive member, and the magnetic particles 8 and the photosensitive member 3 were employed. The evaluations were performed as follows.

In this Example, the contamination of the charging apparatus was evaluated by idling evaluation and then the printing durability tests were carried out as previously mentioned.

The idling test was carried out as follows. In 100 parts by weight of the magnetic particles 8 for the charging apparatus was mixed 1 part of the toner 1 obtained in the manufacturing example. The mixture was applied on the sleeve so as to form a charging nip of about 5 mm wide with the photosensitive member prepared in the photosensitive member manufacturing example 1. Then, the charging apparatus was rotated in idling for ten hours at the speed described above, while the photosensitive member was halted.

Following this, upon application of a DC voltage of −700 V, 50 A4 sheets of solid white were printed to evacuate the toner. Thereafter, a new photosensitive member was mounted to evaluate the charging apparatus in accordance with Evaluation 3 described below. The surface of the magnetic particles was evaluated in accordance with Evaluation 4 described below.

Then the printing performance was evaluated using a printer described above, using the charging apparatus used for the idling test itself to apply a voltage of −700 V, and durability was tested by printing 40,000 sheets at a temperature of 23° C. and a humidity of 65%. In the initial period, the surface potential of the photosensitive member was determined and Evaluations 3, 4 and 5 were carried out. After printing 40,000 sheets, Evaluations 3, 4 and 5 were performed. Separately, the potential of the charging apparatus was measured without mixing toner into the magnetic particles. These results are shown in Table 9. Further durability test was continued, and durability evaluations after the printing of 5,000 sheets and of 10,000 sheets were performed in accordance with Evaluations 1 and 2.

Evaluation 3: To evaluate the charging apparatus, a DC voltage of −700 V was applied the charging member to determine the surface potential rise of the photosensitive member (initially 0 V) after the first one rotation of the photosensitive member.

Evaluation 4: The surface condition of the magnetic particles were examined using a scanning electron microscope on the toner contamination, and rated using the following evaluation criteria.

A=Almost no contamination observed.

B=Some contamination observed.

C=Contamination observed across almost the entire surface.

Evaluation 5: The image obtained at the applied voltage of −700 V was evaluated. Printing was performed on an A4 sheet, with a solid black image (low potential) of a length in the A4 longitudinal direction corresponding to the peripheral length of the photosensitive member (about 94 mm in this Example) immediately succeeded by a solid white image (high potential) of the same size. The charging ghost of the obtained image was evaluated.

When a charging failure occurred, the potential immediately after the solid black image was not increased sufficiently, and as a result, a fogged image appeared in the reverse development. The degree of fogging was evaluated using the following evaluation criteria. Fogging was measured by using a reflection densitometer (Reflectometer model TC-6DS, produced by Tokyo Denshoku Co., Ltd). The worst reflection density value in the printed white area was defined as Ds, the average of reflection density values of a sheet before printing was defied as Dr, and the fogging amount was defined as Ds−Dr.

A=satisfactory (<3%).

B=slight fogging occurred (3% to 5%).

C=inadequate for practical use. A fogged image occurred due to a charging failure (>5%).

These results are shown in Table 9.

EXAMPLE 32

The image evaluation was carried out in the same manner as in Example 31, except that the magnetic particles 9 were used. The results are shown in Table 9.

EXAMPLE 33

The image evaluation was carried out in the same manner as in Example 31, except that the magnetic particles 10 were used. The results are shown in Table 9.

EXAMPLE 34

The image evaluation was carried out in the same manner as in Example 31, except that the magnetic particles 11 were used. The results are shown in Table 9.

EXAMPLE 37

The image evaluation was carried out in the same manner as in Example 31, except that the photosensitive member 5 was used. The results are shown in Table 9.

EXAMPLE 38

The image evaluation was carried out in the same manner as in Example 31, except that the magnetic particles 22 were used. The results are shown in Table 9.

EXAMPLE 39

The image evaluation was carried out in the same manner as in Example 31, except that the magnetic particles 19 were used. The results are shown in Table 9.

COMPARATIVE EXAMPLE 1

The image evaluation was carried out in the same manner as in Example 31, except that the magnetic particles 16 were used. The results are shown in Table 9.

COMPARATIVE EXAMPLE 2

The image evaluation was carried out in the same manner as in Example 31, except that the magnetic particles 21 were used. The results are shown in Table 9.

TABLE 9

| | Electrode Sleeve | Magnetic Particle | Photosensitive Member | Application Condition | Initial State | | | | 4,000 Sheets | | | 5,000 Sheets | 10,000 Sheets |
|---|---|---|---|---|---|---|---|---|---|---|---|---|---|
| | | | | | Initial Potential | Evaluation 3 | Evaluation 4 | Evaluation 5 | Evaluation 3 | Evaluation 4 | Evaluation 5 | Evaluation 1 | Evaluation 1 |
| Embodiment 31 | 6 | 8 | 3 | DC Injection | 685 | 675 | A | A | 660 | A | A | B | C |
| Embodiment 32 | 6 | 9 | 3 | DC Injection | 685 | 675 | A | A | 660 | A | A | B | C |
| Embodiment 33 | 6 | 10 | 3 | DC Injection | 690 | 680 | A | A | 670 | A | A | B | C |
| Embodiment 34 | 6 | 11 | 3 | DC Injection | 690 | 680 | A | A | 670 | A | A | B | C |
| Embodiment 35 | 6 | 12 | 3 | DC Injection | 690 | 670 | B | A | 650 | B | B | C | — |
| Embodiment 36 | 6 | 13 | 3 | DC Injection | 675 | 685 | A | A | 655 | A | B | B | C |
| Embodiment 37 | 6 | 8 | 5 | DC Injection | 680 | 670 | A | A | 655 | A | B | B | C |
| Embodiment 38 | 6 | 22 | 3 | DC Injection | 680 | 670 | A | A | 655 | A | B | B | C |
| Embodiment 39 | 6 | 19 | 3 | DC Injection | 690 | 670 | B | B | 650 | B | B | C | — |
| Comparison Example 1 | 6 | 16 | 3 | DC Injection | 695 | 655 | C | B | 610 | C | C | — | — |
| Comparison Example 2 | 6 | 21 | 3 | DC Injection | 695 | 500 | Blocking | C | — | — | — | — | — |

EXAMPLE 35

The image evaluation was carried out in the same manner as in Example 31, except that the magnetic particles 12 were used. The results are shown in Table 9.

EXAMPLE 36

The image evaluation was carried out in the same manner as in Example 31, except that the magnetic particles 13 were used. The results are shown in Table 9.

EXAMPLE 40

The image evaluation was carried out in the same manner as in Example 31, except that the magnetic particles 14 and the photosensitive member 1 were used; a DC voltage of −700 V superimposed by an AC voltage of 1.6 kV peak-to-peak voltage and a frequency of 1000 Hz was applied to the charging member for the evaluation and durability test; and that a weight was placed inside the photosensitive member to prevent the generation of an AC charging noise. The results are shown in Table 10.

EXAMPLE 41

The image evaluation was carried out in the same manner as in Example 31, except that the magnetic particles 20 were used. The results are shown in Table 10.

COMPARATIVE EXAMPLE 3

The image evaluation was carried out in the same manner as in Example 31, except that the magnetic particles 18 were used. Examined in the initial stage, leak image were formed.

COMPARATIVE EXAMPLE 4

The image evaluation was carried out in the same manner as in Example 40, except that the magnetic particles 15 were used. Since the initial potential was only −580 V when electrified, this was judged as inadequate for practical use.

COMPARATIVE EXAMPLE 5

The image evaluation was carried out in the same manner as in Embodiment 31, except that the magnetic particles 17 were used. The results are shown in Table 10. The charging potential was reduced after the idling, and toner-contamination was observed under an electron microscope.

TABLE 10

| | Electrode Sleeve | Magnetic Particle | Photosensitive Member | Application Condition | Initial State: Initial Potential | Initial State: Evaluation 3 | Initial State: Evaluation 4 | Initial State: Evaluation 5 | 4,000 Sheets: Evaluation 3 | 4,000 Sheets: Evaluation 4 | 4,000 Sheets: Evaluation 5 | 5,000 Sheets: Evaluation 1 | 10,000 Sheets: Evaluation 1 |
|---|---|---|---|---|---|---|---|---|---|---|---|---|---|
| Embodiment 40 | 6 | 14 | 3 | AC Superimposing | 695 | 680 | A | A | 670 | B | A | B | C |
| Embodiment 41 | 6 | 20 | 3 | DC Injection | 680 | 670 | A | A | 655 | A | B | B | C |
| Comparison Example 5 | 6 | 17 | 3 | DC Injection | 680 | 660 | C | B | 625 | C | C | — | — |

What is claimed is:

1. A charging apparatus comprising:

an electrophotographic photosensitive member and a charging member which comprises magnetic particles and placed in contact with the electrophotographic photosensitive member to charge the electrophotographic photosensitive member upon application of a voltage, wherein each magnetic particle (i) has a surface layer containing a polyolefin resin of weight average molecular weight of 10,000 or more, and (ii) has a volume resistivity of $1\times10^4$ to $1\times10^{11}$ Ω cm, and wherein the charging member is held on a conductive member, and (a) an area of the conductive member corresponding to one end of the charging member, or (b) an area of the electrophotographic photosensitive member corresponding to one end of the charging member, is processed for insulation or processed for conductivity.

2. A charging apparatus according to claim 1, wherein the magnetic particles each have a weight average molecular weight of 30,000 or more.

3. A charging apparatus according to claim 2, wherein the magnetic particles each have a weight average molecular weight of 50,000 or more.

4. A charging apparatus according to claim 1, wherein the surface layer of the magnetic particles is formed by direct polymerization.

5. A charging apparatus according to claim 1, wherein the electrophotographic photosensitive member has a charge injection layer as a surface layer.

6. A charging apparatus according to claim 5, wherein the charge injection layer has a volume resistance of $1\times10^8$ to $1\times10^{15}$ Ωm.

7. An electrophotographic apparatus comprising:

an electrophotographic photosensitive member, an exposure means, a developing means, a transfer means and a charging means which comprises magnetic particles and placed in contact with the electrophotographic photosensitive member to charge the electrophotographic photosensitive member upon application of a voltage, wherein each magnetic particle has (i) a surface layer containing a polyolefin resin of weight average molecular weight of 10,000 or more, and (ii) has a volume resistivity of $1\times10^4$ to $1\times10^{11}$ Ωcm, and wherein the charging means is held on a conductive member, and (a) an area of the conductive member corresponding to one end of the charging member, or (b) an area of the electrophotographic photosensitive member corresponding to one end of the charging means, is processed for insulation or processed for conductivity.

8. An electrophotographic apparatus according to claim 7, wherein the magnetic particles each have a weight average molecular weight of 30,000 or more.

9. An electrophotographic apparatus according to claim 8, wherein the magnetic particles each have a weight average molecular weight of 50,000 or more.

10. An electrophotographic apparatus according to claim 7, wherein the surface layer of the magnetic particles is formed by direct polymerization.

11. An electrophotographic apparatus according to claim 7, wherein the electrophotographic photosensitive member has a charge injection layer as a surface layer.

12. An electrophotographic apparatus according to claim 11, wherein the charge injection layer has a volume resistance of $1\times10^8$ to $1\times10^{15}$ Ω cm.

* * * * *

UNITED STATES PATENT AND TRADEMARK OFFICE

CERTIFICATE OF CORRECTION

PATENT NO. : 5,940,662

DATED : August 17, 1999

INVENTOR(S) : YOSHIFUMI HANO, ET AL.

It is certified that error appears in the above-identified patent and that said Letters Patent is hereby corrected as shown below:

AT [56] REFERENCES CITED, Insert:

--FOREIGN PATENT DOCUMENTS
488151 6/1992 European Pat. Off.
617339 9/1994 European Pat. Off.
689103 12/1995 European Pat. Off.--

COLUMN 1

Line 17, "employed;" should read --employed:--.

COLUMN 2

Line 39, "above mentioned" should read --above-mentioned--.

COLUMN 3

Line 54, "when" should read --being--.

COLUMN 5

Line 18, "following" should read --the following--.
Line 39, "following" should read --the following--.
Line 45, "polytetrafluoroethylne" should read --polytetrafluoroethylene--.
Line 58, "functions;" should read --functions:--.

UNITED STATES PATENT AND TRADEMARK OFFICE

CERTIFICATE OF CORRECTION

PATENT NO. : 5,940,662

DATED : August 17, 1999

INVENTOR(S) : YOSHIFUMI HANO, ET AL.

It is certified that error appears in the above-identified patent and that said Letters Patent is hereby corrected as shown below:

COLUMN 6

Line 62, "20" should read --2.0--.

COLUMN 7

Line 2, "essary" should read --essarily--.
Line 32, "long" should read --long- --.
Line 65, "enough" should read --sufficient--.

COLUMN 8

Line 2, "view" should read --view- --.
Line 55, "an urethane" should read --a urethane--.

COLUMN 9

Line 8, "an urethane" should read --a urethane--.
Line 11, "peripheral" should read --peripheral end--.

COLUMN 10

Line 12, "defined" should read --confined--.
Line 45, "follows," should read --follows:--.
Line 63, "an" should read --a--.

UNITED STATES PATENT AND TRADEMARK OFFICE

CERTIFICATE OF CORRECTION

PATENT NO. : 5,940,662

DATED : August 17, 1999

INVENTOR(S) : YOSHIFUMI HANO, ET AL.

It is certified that error appears in the above-identified patent and that said Letters Patent is hereby corrected as shown below:

COLUMN 11

Line 40, "a" should be deleted.

COLUMN 12

Line 47, "Particles" should read --Particle--.

COLUMN 13

Line 48, "were" should read --was--.
Line 52, "triethylaluminium" should read --triethylaluminum--.
Line 53, "diethylaluminium" should read --diethylaluminum--.

COLUMN 14

Line 17, "laluminium" should read --laluminum--; and "diethylaluminium" should read --diethylaluminum--.
Line 62, "was" should read --were--;

COLUMN 15

Line 5, "was" should read --were--.

UNITED STATES PATENT AND TRADEMARK OFFICE

CERTIFICATE OF CORRECTION

PATENT NO. : 5,940,662

DATED : August 17, 1999

INVENTOR(S) : YOSHIFUMI HANO, ET AL.

It is certified that error appears in the above-identified patent and that said Letters Patent is hereby corrected as shown below:

COLUMN 16

Line 9, "laluminium" should read --laluminum--; and "diethylaluminium" should read --diethylaluminum--.
Line 13, "minuets" should read --minutes--;

COLUMN 17

Line 48, "an" should read --a--;
Line 66, "without" should read --with--;

COLUMN 20

Line 27, "4 parts" should be deleted.
Line 46, "Example 16" should read --Examples 16--.

COLUMN 21

Line 47, "kind" should read --kinds--.

COLUMN 25

Line 46, "of the" (second occurrence) should be deleted.

UNITED STATES PATENT AND TRADEMARK OFFICE

CERTIFICATE OF CORRECTION

PATENT NO. : 5,940,662

DATED : August 17, 1999

INVENTOR(S) : YOSHIFUMI HANO, ET AL.

It is certified that error appears in the above-identified patent and that said Letters Patent is hereby corrected as shown below:

COLUMN 27

In Table 9,

"Embodiment" (all occurrences) should read, --Example--.

COLUMN 29

In Table 10,

"Embodiment" (both occurrences) should read --Example--.

Signed and Sealed this

Fourth Day of April, 2000

*Attest:*

*Attesting Officer*

Q. TODD DICKINSON

*Director of Patents and Trademarks*